US010314450B2

(12) United States Patent
Burr

(10) Patent No.: US 10,314,450 B2
(45) Date of Patent: Jun. 11, 2019

(54) VACUUM CLEANER ENVELOPE

(71) Applicant: Alan Graham Burr, Macclesfield (GB)

(72) Inventor: Alan Graham Burr, Macclesfield (GB)

( * ) Notice: Subject to any disclaimer, the term of this patent is extended or adjusted under 35 U.S.C. 154(b) by 19 days.

(21) Appl. No.: 15/732,291

(22) PCT Filed: Apr. 27, 2016

(86) PCT No.: PCT/GB2016/051184

§ 371 (c)(1),
(2) Date: Oct. 19, 2017

(87) PCT Pub. No.: WO2016/174423

PCT Pub. Date: Nov. 3, 2016

(65) Prior Publication Data

US 2018/0368634 A1 Dec. 27, 2018

(30) Foreign Application Priority Data

Apr. 27, 2015 (GB) ..... 1507091.5

(51) Int. Cl.

| | |
|---|---|
| ***A47L 9/10*** | (2006.01) |
| ***A47L 9/14*** | (2006.01) |
| ***A47L 7/00*** | (2006.01) |
| *E01H 1/12* | (2006.01) |

(52) U.S. Cl.

CPC ..... *A47L 9/1418* (2013.01); *A47L 7/0014* (2013.01); *A47L 7/0071* (2013.01); *A47L 9/104* (2013.01); *A47L 9/14* (2013.01); *A47L 9/1409* (2013.01); *E01H 1/1206* (2013.01)

(58) Field of Classification Search

CPC ..... A47L 5/365; A47L 7/0071; A47L 9/102; A47L 9/104; A47L 9/14; A47L 9/1409; A47L 9/1418; A47L 9/1683; A47L 9/1691

See application file for complete search history.

(56) References Cited

U.S. PATENT DOCUMENTS

| | | | | |
|---|---|---|---|---|
| 3,568,413 | A * | 3/1971 | Jerabek | A47L 9/20 15/327.6 |
| 4,531,258 | A * | 7/1985 | Spellman | A47L 9/1418 15/327.1 |
| 2007/0101535 | A1 | 5/2007 | Maier et al. | |
| 2008/0127832 | A1* | 6/2008 | Zhang | A47L 9/125 96/416 |
| 2008/0250600 | A1* | 10/2008 | Windrich | A47L 5/365 15/349 |
| 2011/0118680 | A1* | 5/2011 | Michaels | A47L 5/365 604/317 |

FOREIGN PATENT DOCUMENTS

| | | |
|---|---|---|
| EP | 1428619 A1 | 6/2004 |

* cited by examiner

*Primary Examiner* — Ryan A Reis

(57) ABSTRACT

An envelope (10) for use with a vacuum cleaner, the envelope (10) comprising flexible material arranged to provide a fluid path there-through, and further comprising a coupling arranged to couple the envelope (10) to a structural member for in use maintaining the fluid path open by supporting the envelope (10) against external pressure, wherein the envelope (10) is arranged in use to isolate, from the fluid path, the structural member that supports the envelope (10).

15 Claims, 18 Drawing Sheets

VACUUM CLEANER ENVELOPE

FIELD OF THE INVENTION

The present invention relates to vacuum cleaner envelopes, and to related methods of use of vacuum cleaner envelopes.

BACKGROUND TO THE INVENTION

Vacuum cleaners are typically used for domestic and industrial cleaning of dirt. Solid and/or liquid dirt is aspirated by the vacuum cleaner such that the dirt is communicated via a fluid path from a nozzle to a collection chamber. The fluid path for a vacuum cleaner includes the nozzle, a conduit and the material collection chamber of the vacuum cleaner. If the dirt is wet and/or is fine (for example dry wall material or dust from a sander), or is hazardous (for example bodily fluid), dirt residue may remain in the vacuum cleaner resulting in bacterial growth, odour problems and environmental health risks. Emptying and cleaning the fluid path to avoid these problems is dirty, unhygienic and potentially dangerous to a user.

US 2008/127832 A1 discloses an envelope for use with a vacuum cleaner according to the preamble of claim 1.

Example embodiments of the present invention aim to address at least one of the issues identified above, or related issued.

SUMMARY OF THE INVENTION

An envelope for use with a vacuum cleaner is provided. The envelope comprising flexible material arranged to provide a fluid path there-through, and further comprising a coupling arranged to couple the envelope to a structural member for in use maintaining the fluid path open by supporting the envelope against external pressure; wherein: the envelope is arranged in use to isolate, from the fluid path, the structural member that supports the envelope.

Furthermore, an envelope assembly for use with a vacuum cleaner is provided. The envelope assembly comprising:

an envelope for use with a vacuum cleaner and comprising flexible material arranged to provide a fluid path there-through, and further comprising a coupling arranged to couple the envelope to a structural member for in use maintaining the fluid path open by supporting the envelope against external pressure; and the structural member that is coupled to the coupling and that supports the envelope, wherein:

the envelope isolates, from the fluid path, the structural member.

In one example embodiment, the coupling is arranged to receive a plurality of structural members. In one example embodiment, a plurality of said couplings are provided.

In one example embodiment, the envelope comprises one or more of a flexible polymer; a flexible plastic; a flexible rubber; a flexible textile. The envelope comprises an impermeable material, such as a material that inhibits passage of liquids there-through, for example a waterproof material, or a solvent-resistant material. In this way, the envelope provides a fluid path, for example a path for liquid and/or gas and/or dispersion and/or a suspension of solids in a liquid and/or gas. In this way, the envelope provides a barrier between the fluidic path internally and its surroundings externally.

In one example embodiment, the envelope is arranged to in use receive dirt, in solid or liquid form. In one example embodiment, the envelope is arranged to in use retain dirt, in solid or liquid form, therein. In one example embodiment, the envelope comprises a collection chamber for dirt, in solid or liquid form. In one example embodiment, the envelope comprises a collection chamber for dirt, in solid or liquid form that receives and retains dirt therein. In this way, the envelope may be used to receive and retain, for example, wet and dry spillages, industrial spillages, builders' debris, hospital waste, and/or animal excrement.

In one example embodiment, the envelope comprises one or more of a biodegradable material; a compostable material; a recyclable material; a burnable material. In one example embodiment, the envelope comprises material having portions of different gauges, for example different thicknesses. In one example embodiment, the envelope comprises a transparent material. In this way, fitment and usage of the envelope may be facilitated. In one example embodiment, the envelope is provided with a distinguishing mark, for example a coloured portion. In this way, different types of envelope suitable for various categories of waste may be denoted according to their intended use.

In one example embodiment, the envelope provides a fluid path with a single inlet and a single outlet. That is, in one example embodiment the envelope provides a fluid path between an inlet and an outlet, said fluid path not comprising additional inlets and/or outlets and/or holes and/or perforations therein.

In one example embodiment, the envelope provides an elongate fluid path therethrough. In one embodiment, the envelope is arranged to, in use, form a generally circular cross-section. In one example embodiment, the envelope is arranged to, in use, form a constant cross-section along its length. In example embodiments, the envelope comprises one or more of: a tubular shape, a cylindrical shape, a conical shape, a spherical shape, a pyramidal shape.

In one example embodiment, the envelope is packable, for example by rolling and/or by folding. For example, the envelope may be flattened such that the fluid path therethrough is collapsed, such as by bringing a portion of an internal surface of the fluid path proximal to an opposing portion of the internal surface of the fluid path. In this way, for example, an envelope may be packed into a roll, for example, or a dispensing canister or cassette, either as an individual unit or in association or combination with further such envelopes.

In one example embodiment, the envelope is associated with a second such envelope. For example, the envelope may be arranged with a second such envelope to be cut and/or tom or otherwise detached from said second envelope. In this way, two, three or more generally a plurality of such envelopes may be manufactured and supplied, for example, on a roll or in a dispensing canister or cassette.

The coupling is arranged to receive a structural member in coupling the envelope thereto. The coupling comprises a conduit and/or channel and/or cavity and/or seam and/or support fixture arranged to couple a structural member thereto. In one example embodiment, the coupling comprises a plurality of conduits and/or channels and/or cavities and/or seams and/or support fixtures arranged to couple a structural member thereto, for example by receiving a structural member and/or a plurality of structural members in one or more thereof. In one example embodiment, the coupling is arranged to receive a structural member within the material of, such as within a wall portion of the envelope. The coupling may be arranged to partly or wholly receive a structural member therein.

In one example embodiment, the coupling is arranged to couple a structural member to the envelope proximal a surface of the envelope, for example, an outer surface and/or an inner surface of the envelope. The envelope is arranged to isolate a structural member from the fluid path in use. In this way, a structural member is in use not in fluid communication with fluid in the fluidic path so the structural member does not become contaminated by dirt in the fluid path.

In one example embodiment, the coupling is arranged to in use couple a structural member to the envelope in a manner by which the structural member does not obstruct movement along the fluid path.

In one example embodiment, the envelope comprises an inlet adapted to in use cooperate with a cleaning nozzle of a vacuum cleaner. In this way, dirt may in use enter the envelope, passing into the fluid path.

In one example embodiment, the envelope comprises an outlet adapted to in use cooperate with a suction unit of a vacuum cleaner. In this way, air may exit the envelope into, passing out of the fluid path and into a suction unit of a vacuum cleaner.

In one example embodiment, the envelope comprises a first chamber to, in use receive incoming fluid, and/or in use to collect dirt. In one example embodiment, the first chamber is located proximate an inlet of the envelope. In one example embodiment, the envelope comprises a second chamber, the second chamber located proximate to an outlet of the envelope. In one example embodiment there is provided a divider in the fluid path, the divider arranged between first and second chambers in the fluid path. In one example embodiment, the divider comprises a partial obstruction in the fluid path. In one example embodiment the first chamber comprises a collection chamber for dirt.

In one example embodiment, the envelope comprises a flow diverter, such as provided by a flow member. In one example embodiment, the flow diverter is arranged to, in use, deflect and/or divert fluid in the fluid pathway. In one example embodiment, a flow diverter comprises a flow member arranged to in use provide a partial obstruction in the fluid path.

In one example embodiment, the flow diverter comprises a rigid flow deflector. In one example embodiment, the flow diverter comprises a tongue that extends into the fluid pathway. In this way, dirt may be deflected into, for example, a collection chamber of the envelope.

In one example embodiment, the envelope in use comprises a non-linear fluid path. In one example embodiment, an inlet and an outlet of the envelope are arranged on a same lateral side of the envelope chamber, with the flow diverter arranged axially there-between. In one example embodiment, the envelope comprises a flow diverter in the form of a baffle and/or partial barrier arranged in use between an inlet and an outlet of the fluid pathway.

In one example embodiment, the envelope comprises a flow member arranged to, in use, slow fluid in the fluid pathway. In one example embodiment, the envelope comprises a flow member arranged to, in use, slow fluid in the fluid pathway whereby the dirt entrained therein is retained in, for example by falling into a collection chamber of the envelope.

In one example embodiment, the envelope comprises an inlet in fluid communication with a collection chamber and a flow member arranged in the fluid pathway such that in use air and dirt enters the envelope at the inlet, is deflected by the flow member into the collection chamber, the dirt is slowed and/or falls into the collection and air exits the collection chamber to then pass from the envelope through an outlet of the envelope.

In one example embodiment, the envelope comprises reinforcement. In one example embodiment, the envelope comprises reinforcement arranged to reinforce and/or support the flow diverter.

In one example embodiment, the coupling is arranged to receive a structural member by insertion and/or pushing and/or pulling and/or clipping into and/or onto the envelope. In one example embodiment, the coupling is arranged to receive the structural member by insertion and/or pushing and/or pulling and/or clipping into and/or onto the coupling. For example, a structural member may be inserted into a wall portion of the envelope.

In one example embodiment, the coupling is arranged for removal of a structural member in which the structural member is retracted and/or removed and/or pushed and/or pulled and/or unclipped from and/or out thereof. For example, a structural member may be pulled from within a wall portion of the envelope.

In one example embodiment, a structural member is arrangeable to extend along an axis of the envelope. For example, a structural member comprises a rod to span the envelope along its axis. In one example embodiment, a structural member may in use be arranged to extend across a diameter of the envelope. In one example embodiment, a structural member may in use be arranged to extend around a diameter of the envelope. For example, a structural member may comprise a ring. In one example embodiment, a structural member may in use be arranged to extend along an axis of the envelope and around a diameter of the envelope. For example, a structural member may in use be arranged as a helical support for the envelope. In one example embodiment, the structural member may comprise a rod arranged to be inserted into a conduit provided by or in the envelope. For example, a straight rod (e.g. a flexible straight rod) may be inserted into a helical conduit, or a helical rod may be inserted into a helical conduit.

In one example embodiment, a structural member may comprise a conduit extending along a bore thereof. In this way, a fluid, for example a gas, such as air, may be communicated along the structural member. In one example embodiment, a structural member may be partly inserted into a conduit in an envelope and a fluid, for example a gas, may be communicated along the structural member. In this way, a conduit in an envelope arranged to receive a structural member may be inflated to facilitate insertion of the structural member into the conduit.

In one example embodiment, a structural member is arranged to support the envelope so as to, in use, maintain the fluid path provided by the envelope. That is, the structural member tends to maintain a volume enclosed by the envelope. For example, a structural member may resist the envelope, in use, from collapsing when the envelope is used with a vacuum cleaner, for example, when pressure inside the envelope is less than pressure outside the envelope.

In one example embodiment, the coupling is arranged to couple the envelope to a plurality of structural members, for example, two or more structural members. In one example embodiment, the envelope is arranged to receive a plurality of similar structural members, for example, two or more structural members in which the structural members are the same shape and/or size and/or type and/or stiffness and/or rigidity. In one example embodiment, the envelope is arranged to receive a plurality of dissimilar structural members, for example, two or more structural members in which the structural members are of different shape and/or size and/or type and/or stiffness and/or rigidity.

In one example embodiment, the envelope assembly comprises a plurality of structural members, for example, two or more structural members, in which the structural members are similar. In one example embodiment, the envelope assembly comprises a plurality of structural members, for example, two or more structural members, in which the structural members are dissimilar.

In one example embodiment, the envelope comprises a closure feature. In one example embodiment, the envelope comprises a plurality of closure features. In one example embodiment, the closure features are arranged to be closable, for example tied and/or sealed and/or bonded to close the envelope, for example, at one end and/or both ends of the envelope. In one example embodiment, the envelope comprises closure features, such as a tie and/or seal at one end or both ends. In this way, an envelope containing dirt may be closed so as to facilitate hygienic disposal of the envelope with the dirt therein.

In one example embodiment, the coupling is arranged to couple the envelope to one or more of structural members such that the envelope is, in use, stressed by the structural member(s). For example, a tensile stress may be induced by the structural member in wall portions of the envelope. In use, a structural member may be rotated and/or translated and/or stressed itself, to provide a means by which the envelope is put under stress e.g. tension.

In one example embodiment, the envelope comprises a fixing arranged to fix the envelope to the vacuum cleaner. In one example embodiment, the envelope may comprise one or more fixings at the inlet and/or outlet of the fluid path so that the envelope may in use be fixed to one or more parts of a vacuum cleaner.

In one example embodiment, the fixings may comprise a fixing member e.g. a ring connector at an end of the envelope to in use fix the envelope to an outlet or fan or motor or a nozzle or a suction chamber of a vacuum cleaner.

In one example embodiment, the envelope comprises a filter and/or filter membrane. For example, the envelope may comprise a HEPA filter. For example, the fixing member e.g. ring connector may comprise a biodegradable and/or disposable filter membrane. In one example embodiment, the envelope comprises a fixing that includes or cooperates with a filter and/or filter membrane of the envelope.

A further example embodiment provides a vacuum cleaner system comprising:

- a vacuum cleaner;
- an envelope assembly substantially as described herein, with particular reference to the example embodiments set out above.

A still further example embodiment provides a kit of parts including:

- an envelope substantially as described herein, with particular reference to the example embodiments set out above; and
- a structural member arrangeable in use to support the envelope.

An example embodiment provides a method of using an envelope with a vacuum cleaner, wherein the envelope is substantially as described herein, with particular reference to the example embodiments set out above, the method comprising:

- supporting the envelope with a structural member;
- fixing the envelope to the vacuum cleaner;
- operating the vacuum cleaner to collect dirt in the envelope.

In one example embodiment, the method comprises receiving the structural member into the envelope. In one example embodiment, the method comprises fixing an end of the envelope to the vacuum cleaner. In one example embodiment, the method comprises a subsequent step of removing the envelope from the vacuum cleaner. In one example embodiment, the method comprises closing the envelope. In one example embodiment, the method comprises removing the structural member from the envelope. In one example embodiment, the method comprises disposing of the envelope.

In one example embodiment, the envelope may be fixed to the vacuum cleaner and subsequently, a structural member may be provided to support the envelope. For example, the envelope may be attached to a vacuum cleaner and subsequently, a structural member may be inserted into the envelope.

According to the present invention there is provided an apparatus and method as set forth in the any appended claims. Other features of the invention will be apparent from any dependent claims, and the description which follows.

BRIEF INTRODUCTION TO THE DRAWINGS

For a better understanding of the invention, and to show how embodiments of the same may be carried into effect, reference will now be made, by way of example, to the accompanying diagrammatic drawings in which.

Figure 4A:
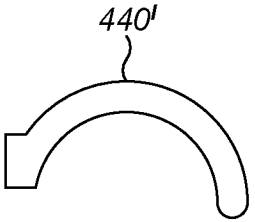

FIG. 4*a* shows a schematic elevation of a flow diverter according to an example embodiment.

Figure 4B:
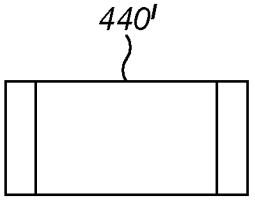

FIG. 4*b* shows a schematic plan view of the example embodiment of FIG. 4*a;*

Figure 1:
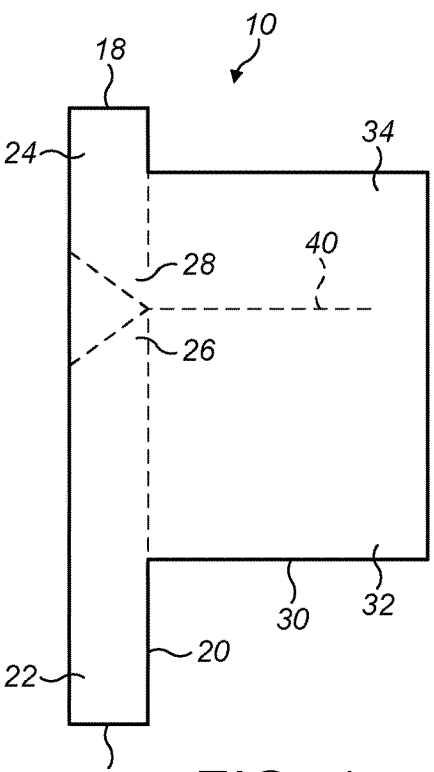
FIG. 1 shows a schematic side elevation of an envelope according to an example embodiment.
Figure 6:
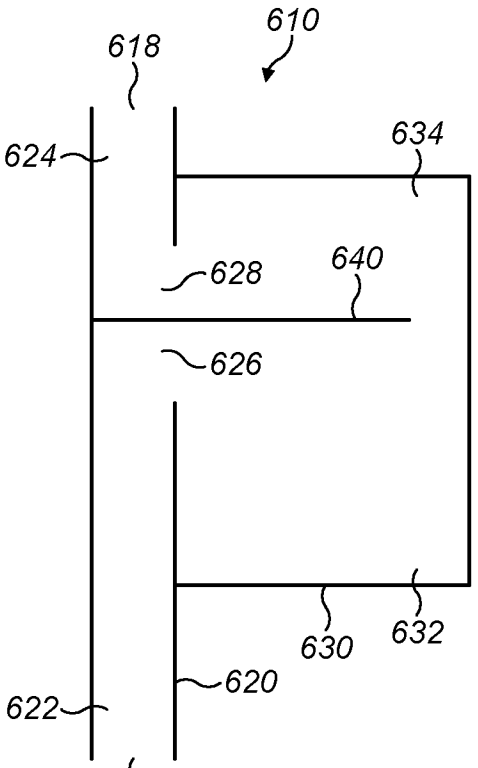
Figure 5:
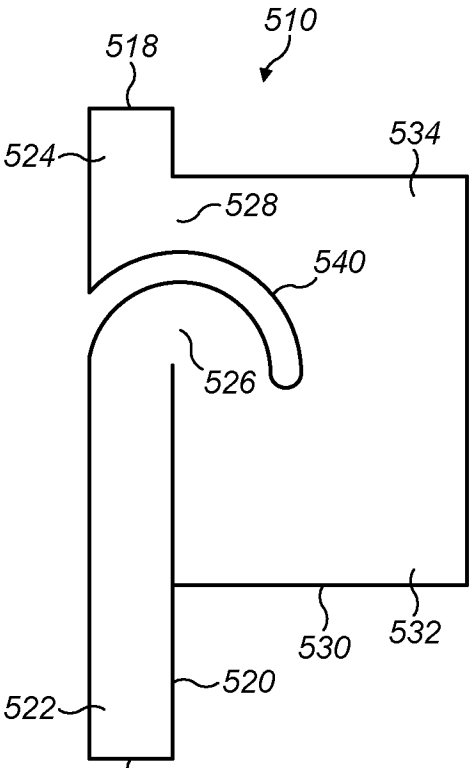
Figure 8:
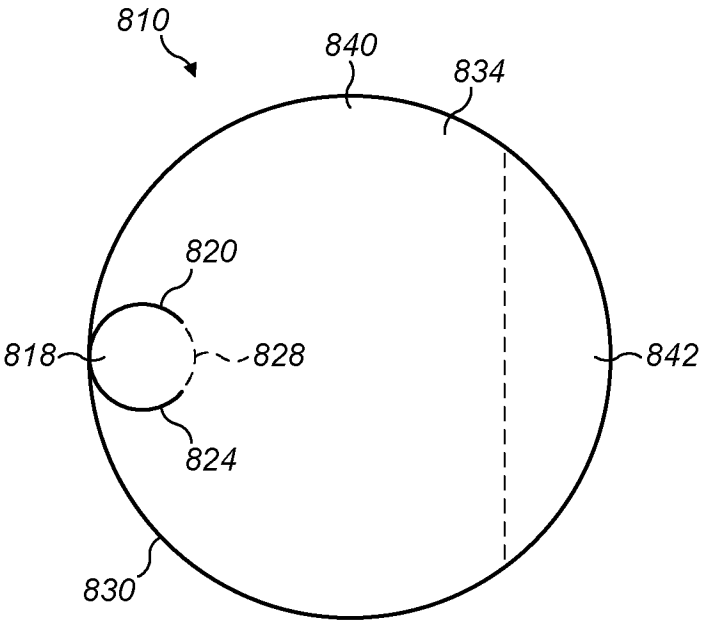
Figure 7:
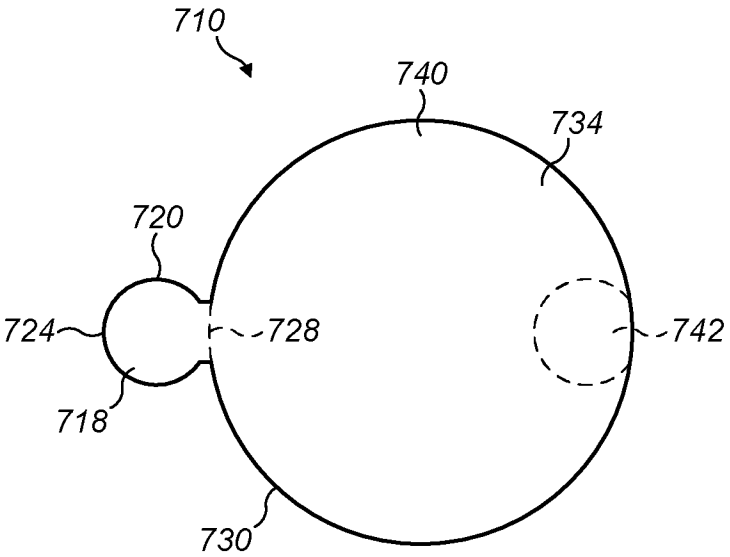
Figure 11:
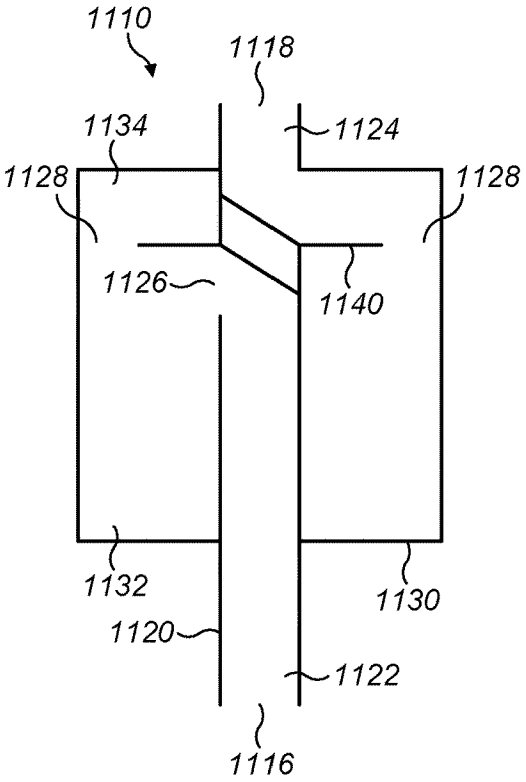
Figure 10:
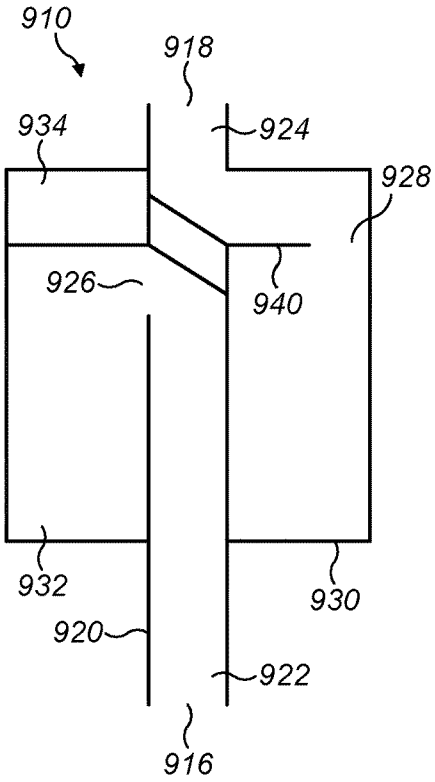
Figure 9:
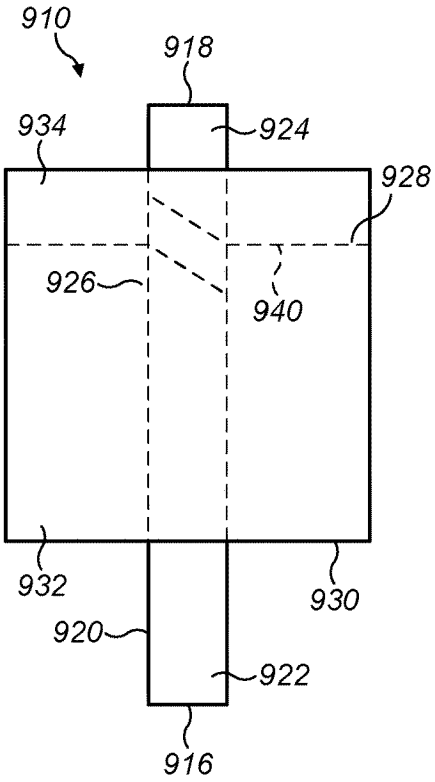
Figure 13:
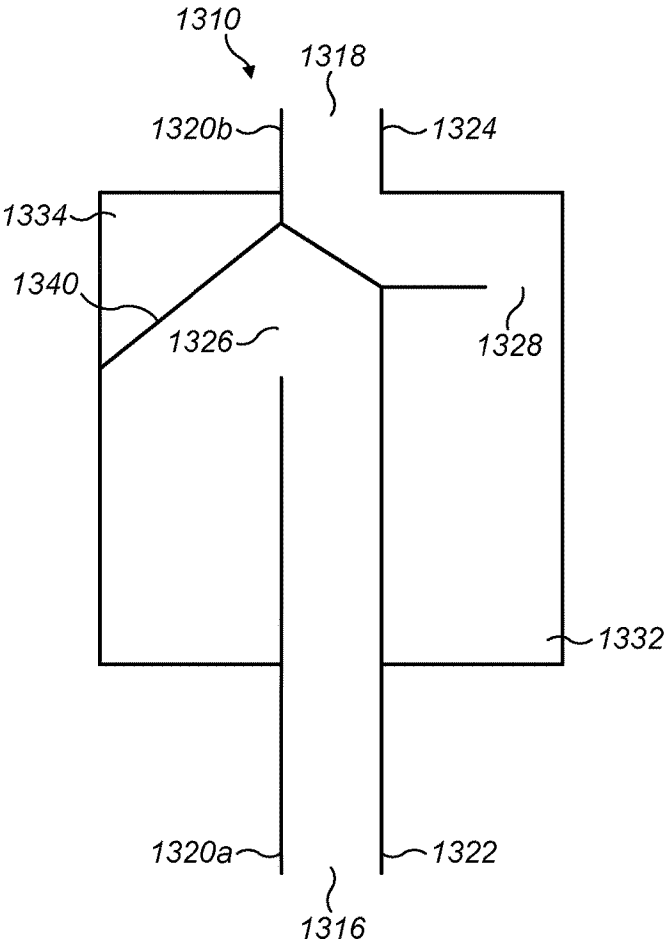
Figure 12:
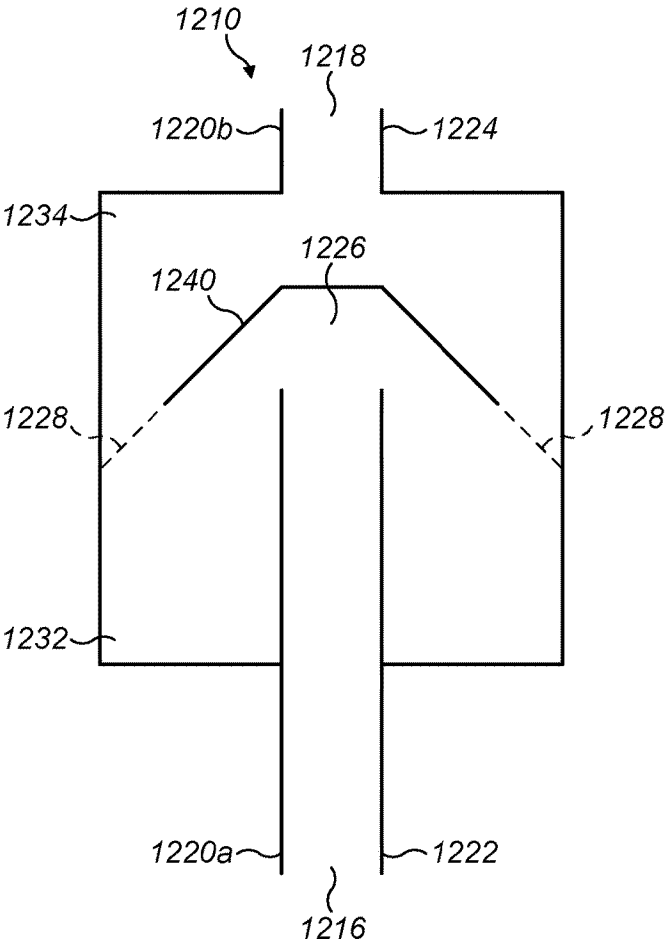
Figure 16:
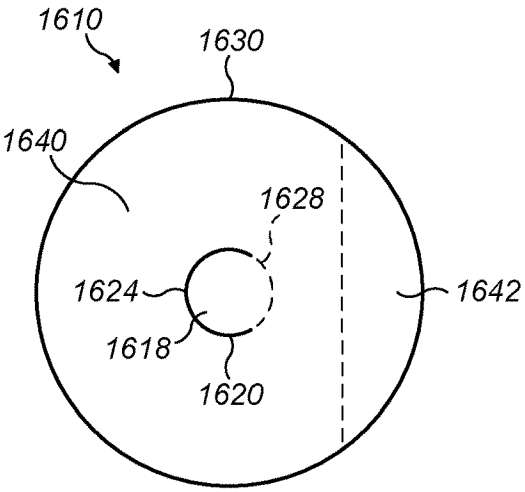
Figure 15:
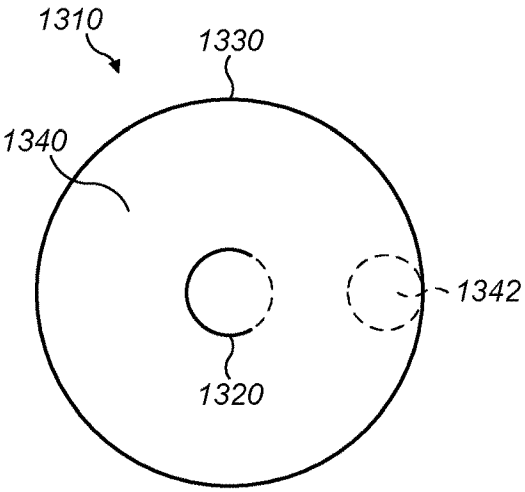
Figure 14:
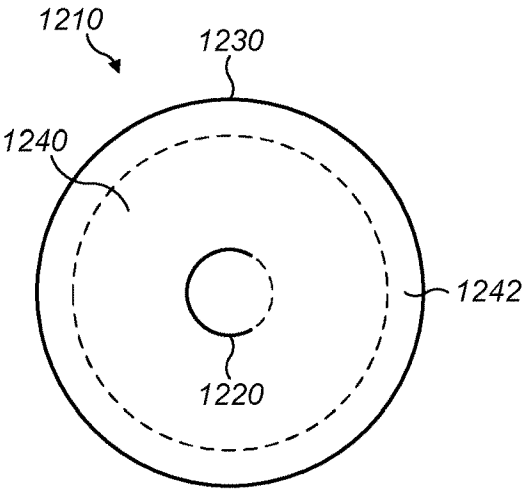
Figure 18:
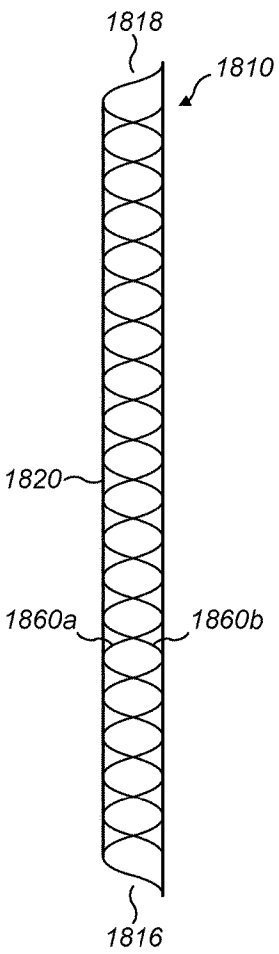
Figure 17:
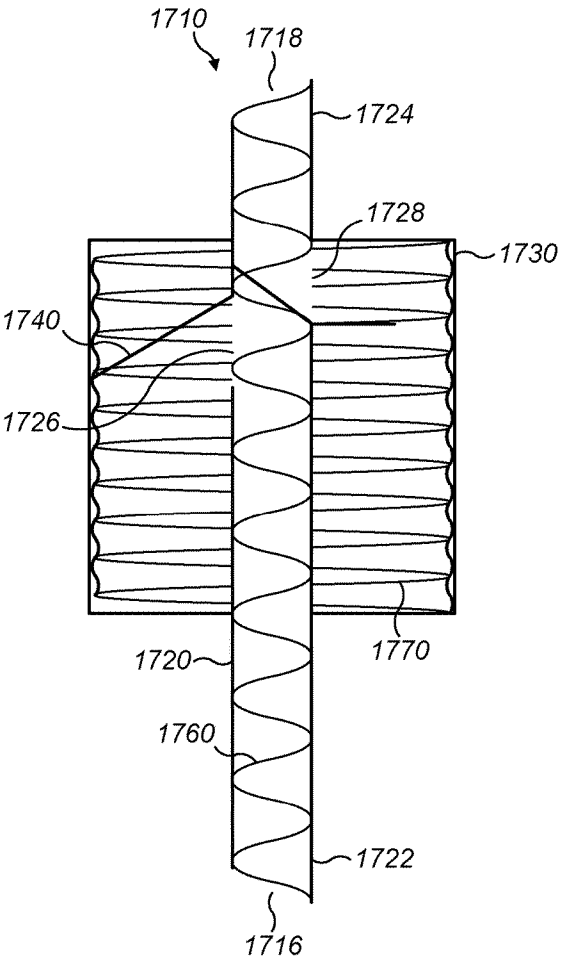
Figure 19:
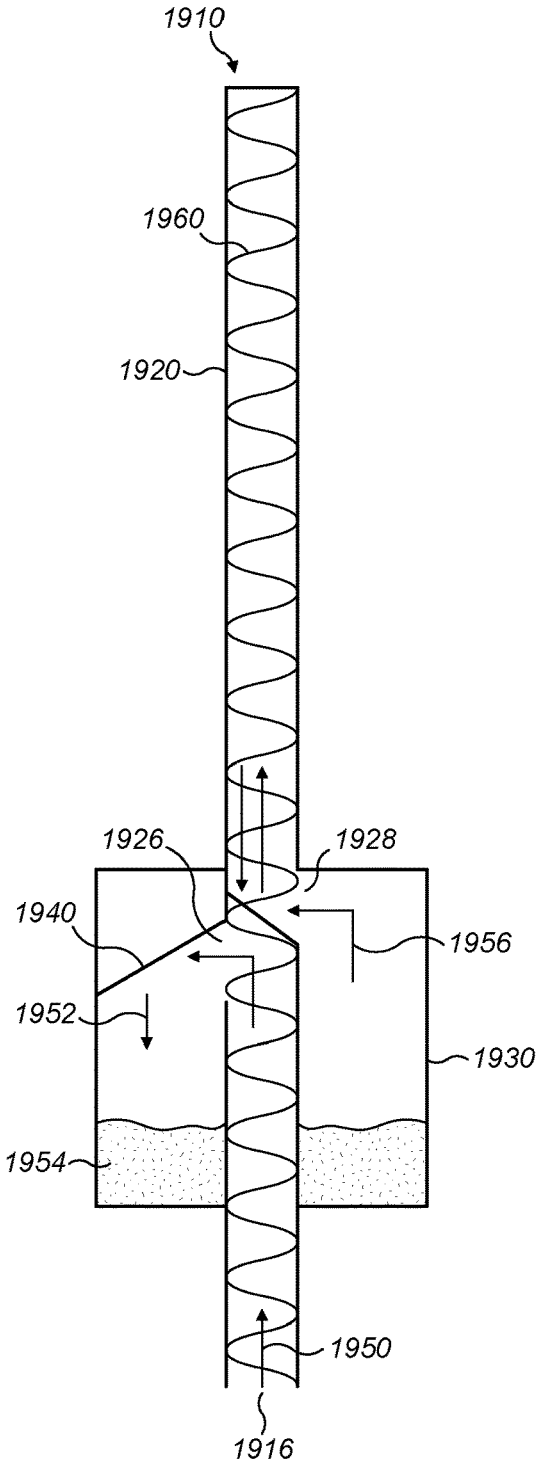
Figure 20:
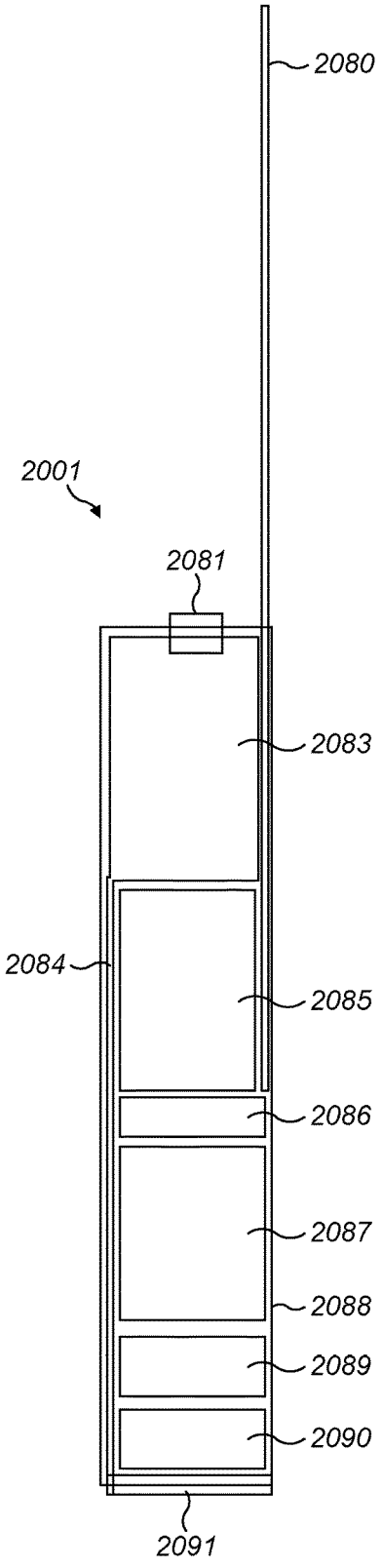
Figure 21:
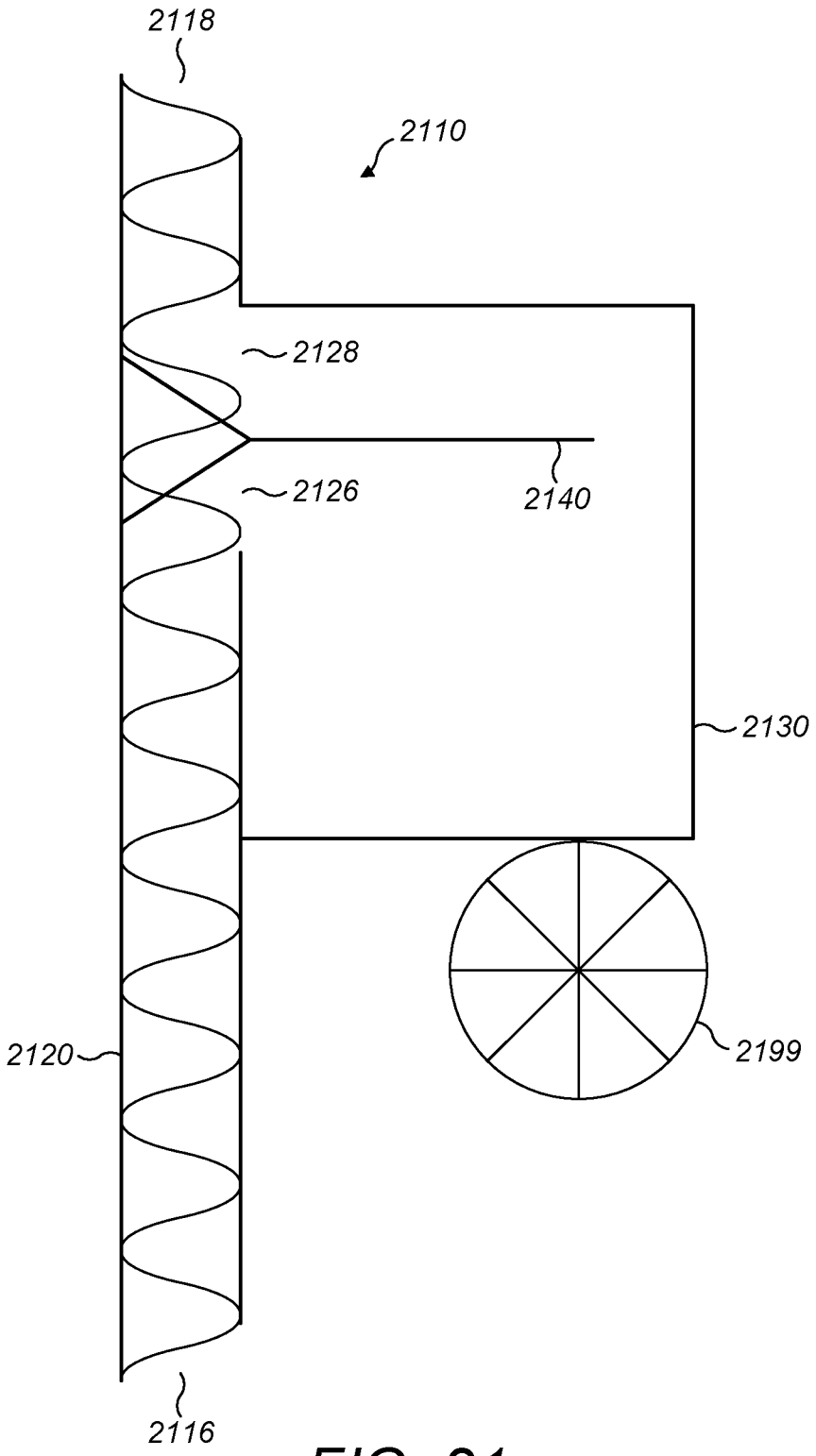
Figure 22:
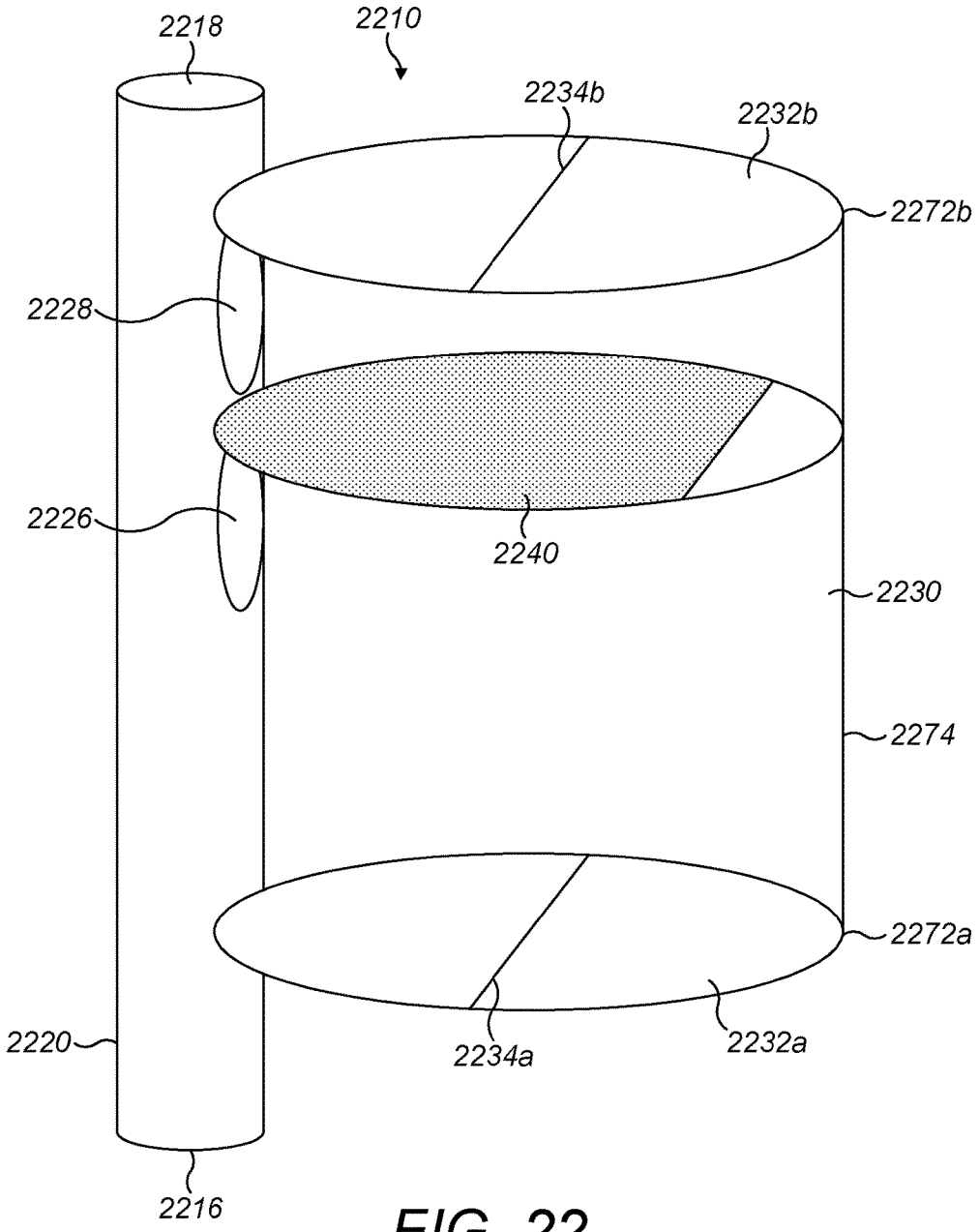
Figure 24:
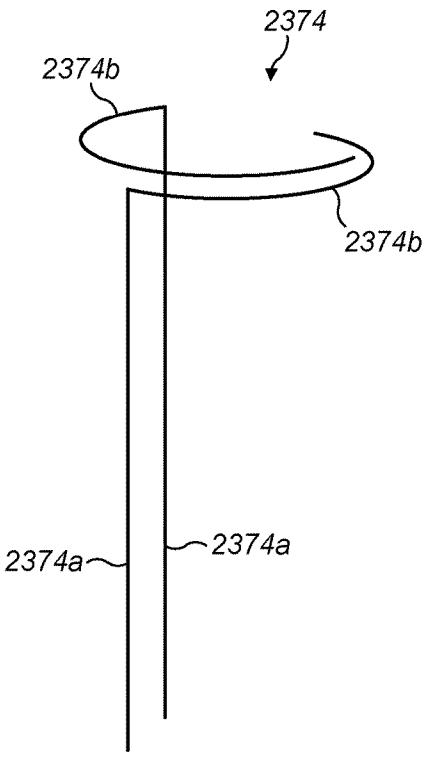
Figure 23:
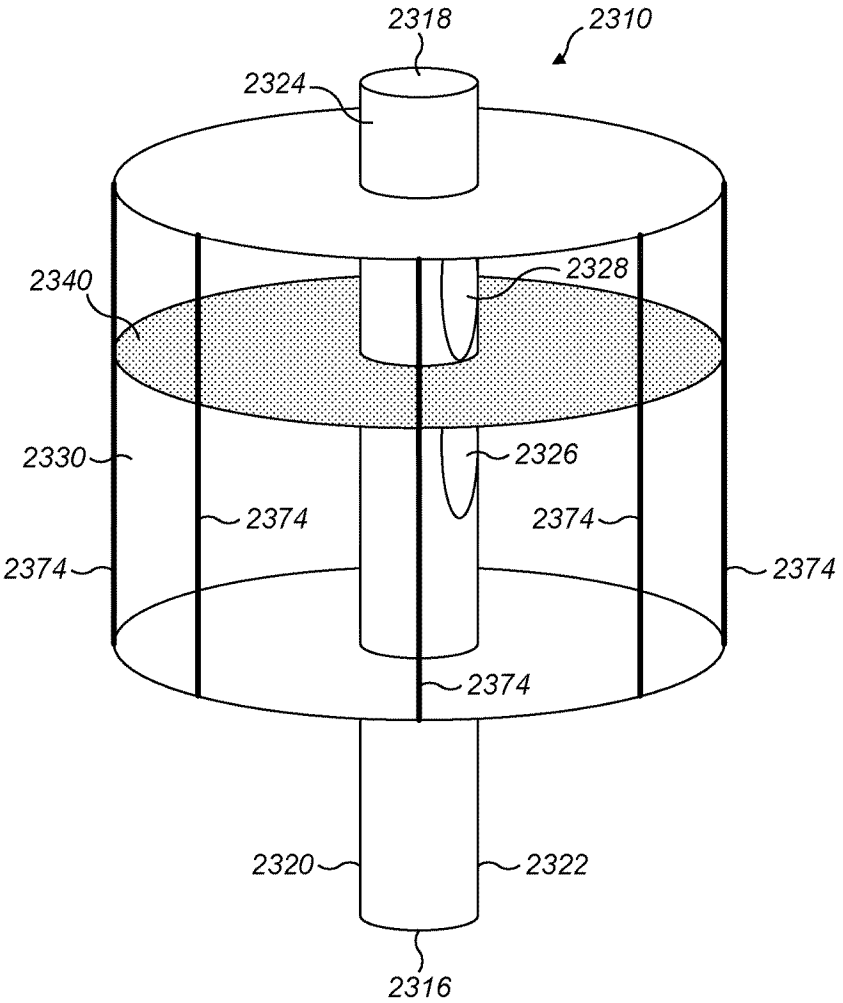
Figure 25:
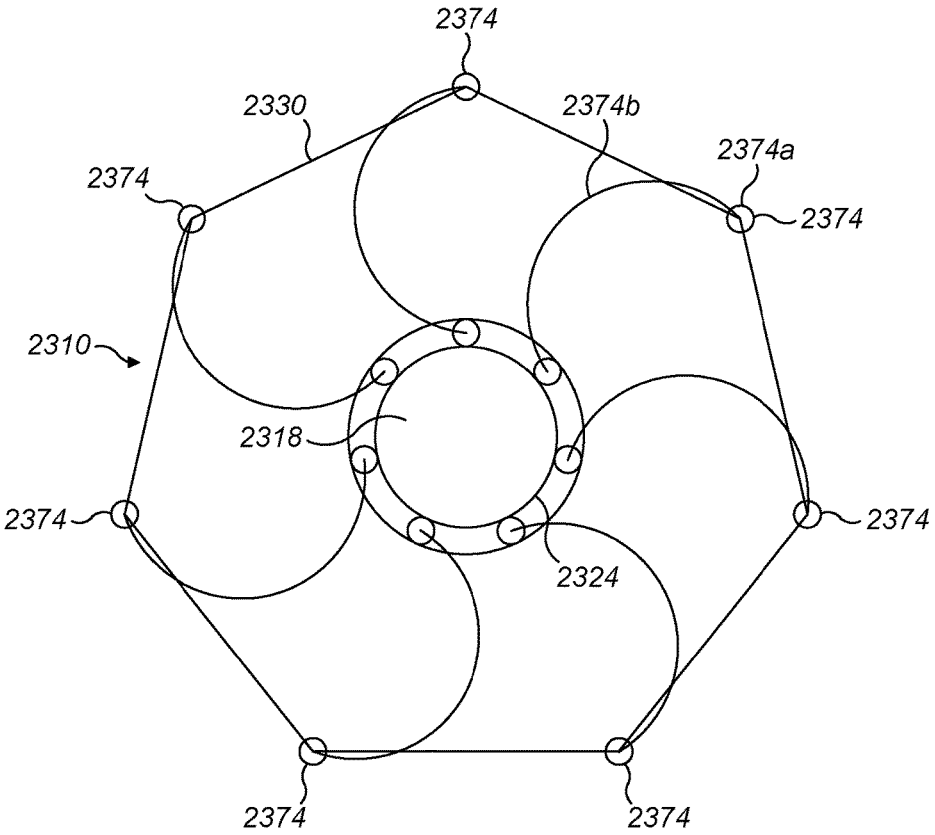
Figure 26A:
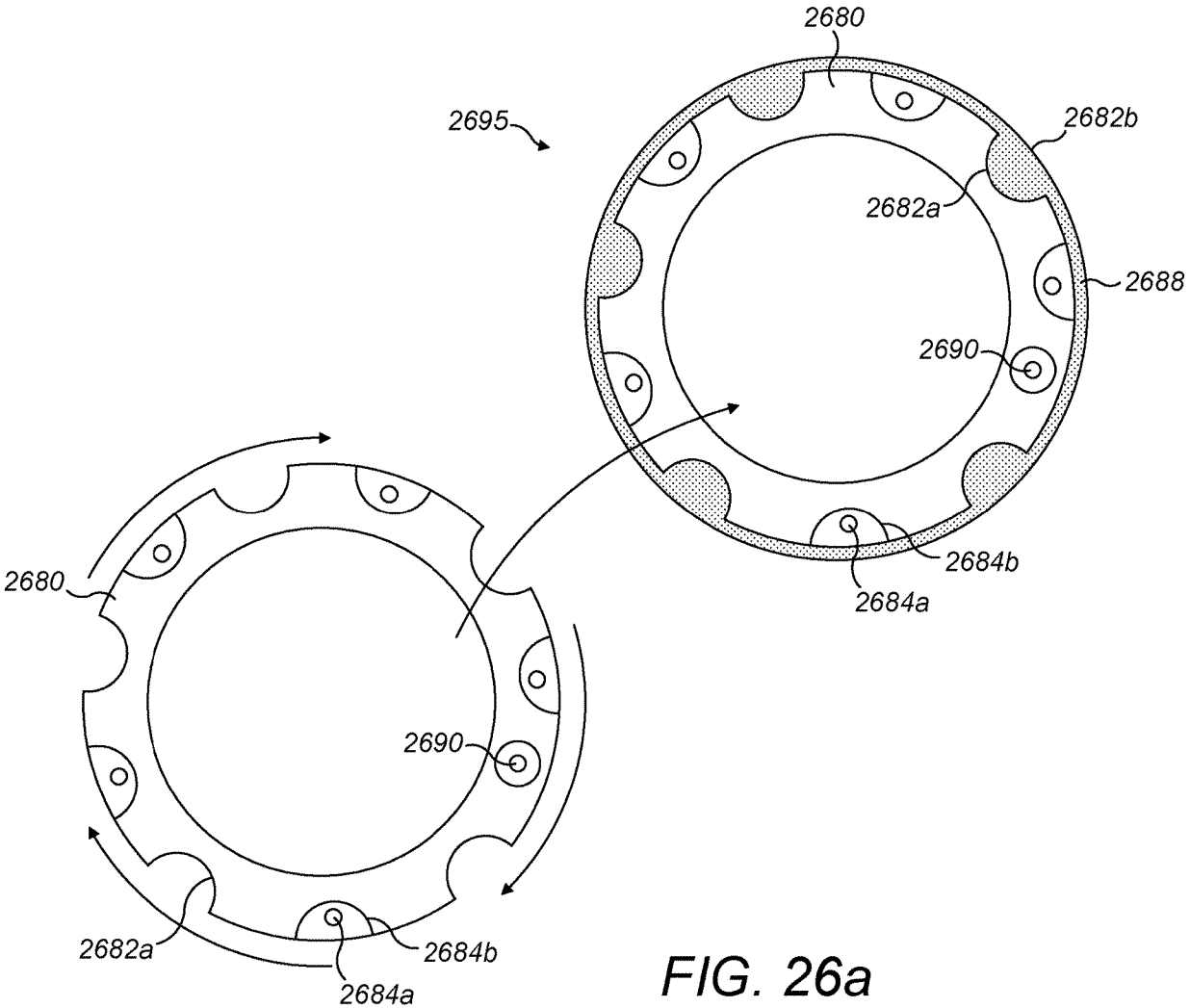
Figure 26B:
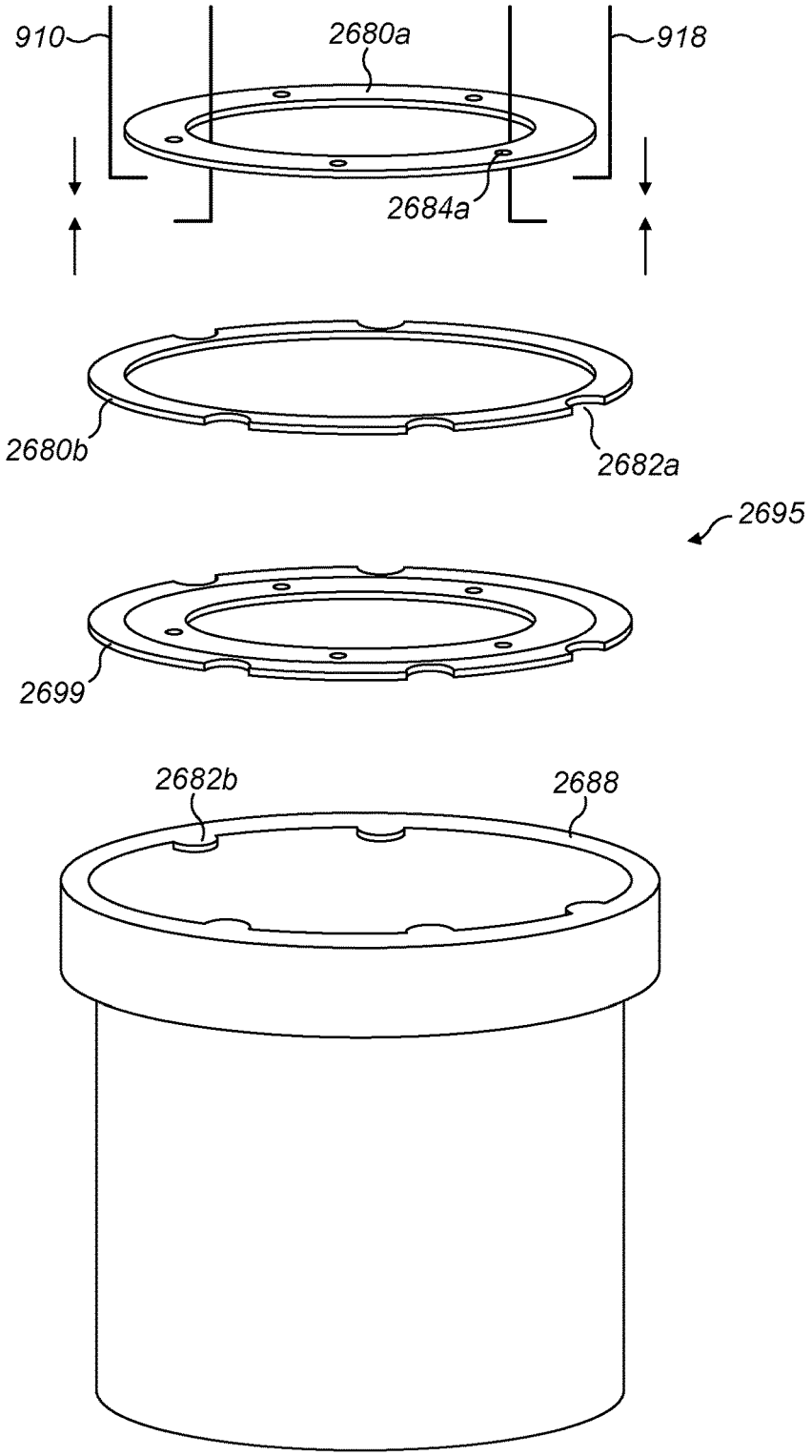

FIG. 5 shows a schematic cross sectional view of an envelope according to another example embodiment;

FIG. 6 shows a schematic cross sectional view of an envelope according to yet another example embodiment;

FIG. 7 shows a schematic plan view of an envelope according to an example embodiment, said envelope being related to the envelope of FIG. 1;

FIG. 8 shows a schematic plan view of an envelope according to an example embodiment, said envelope being related to the envelope of FIG. 1;

FIG. 9 shows a schematic side elevation of an envelope according to still yet another example embodiment;

FIG. 10 shows a schematic cross sectional view of the example embodiment of FIG. 9;

FIG. 11 shows yet another schematic cross sectional view of the example embodiment of FIG. 9;

FIG. 12 shows a schematic cross sectional view of an envelope according to still yet another example embodiment;

FIG. 13 shows a schematic cross sectional view of an envelope according to still yet another example embodiment;

FIG. 14 shows a schematic plan view of the example embodiment of FIG. 12;

FIG. 15 shows a schematic plan view of an embodiment related to the example embodiment of FIG. 13;

FIG. 16 shows a schematic plan view of the example embodiment of FIG. 13;

FIG. 17 shows a schematic cross sectional view of the example embodiment of FIG. 13;

FIG. 18 shows a schematic cross sectional view of an envelope according to still yet another example embodiment;

FIG. 19 shows a schematic cross sectional view of an envelope according to still yet another example embodiment, in use;

FIG. 20 shows a schematic cross sectional view of a vacuum cleaner according to an example embodiment;

FIG. 21 shows a schematic cross sectional view of an envelope according to still yet another example embodiment;

FIG. 22 shows a schematic perspective view of an envelope according to still yet another example embodiment;

FIG. 23 shows a schematic perspective view of an envelope according to still yet another example embodiment;

FIG. 24 shows a schematic perspective view of a structural member according to an example embodiment;

FIG. 25 shows a schematic plan view of the example embodiment of FIG. 23;

FIG. 26*a* shows a schematic elevation of a locator member assembly according to an example embodiment;

FIG. 26*b* shows a schematic exploded perspective elevation of the locator member assembly according to the example embodiment of FIG. 26*a;*

Figure 27:
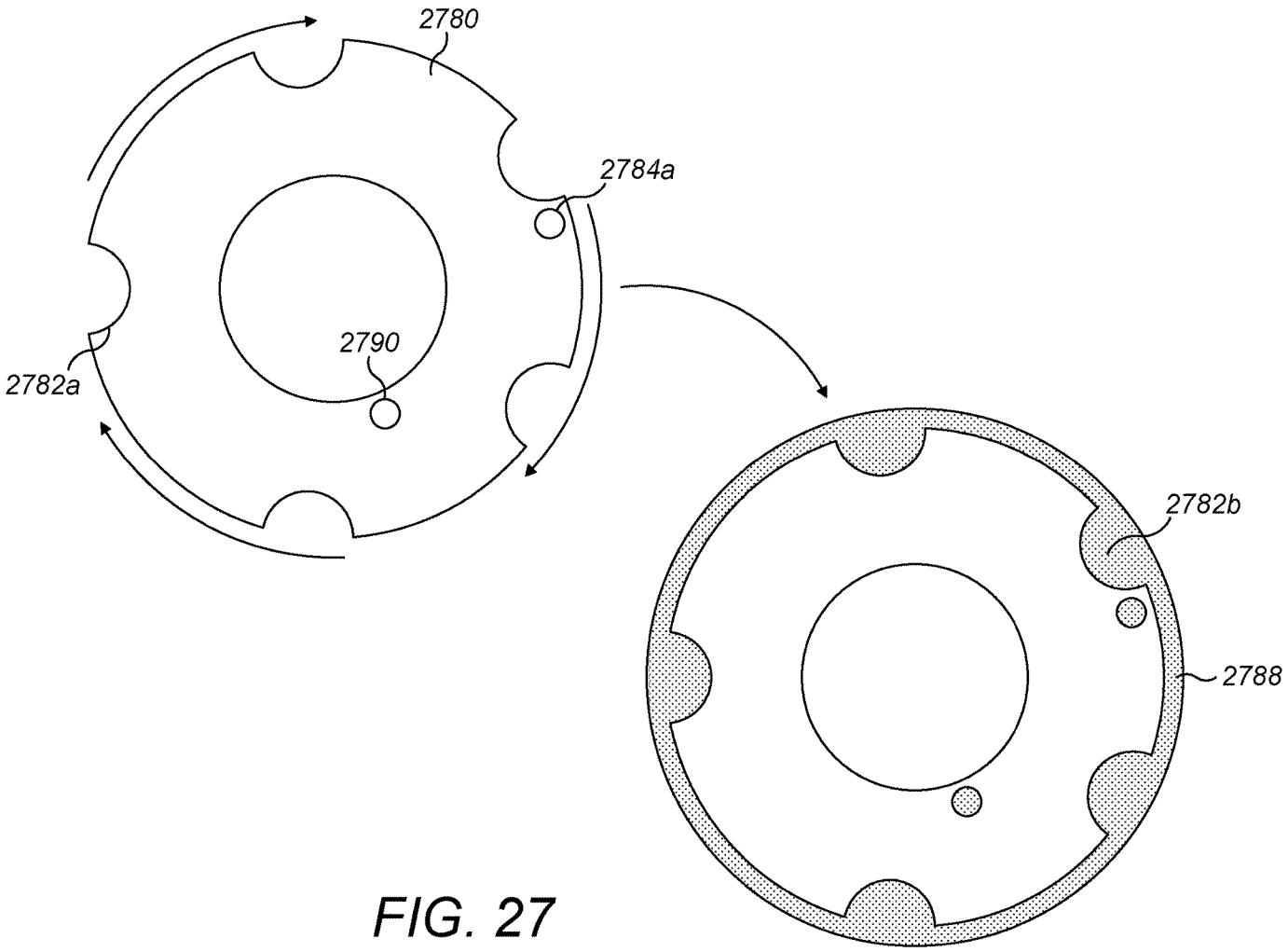
Figure 28:
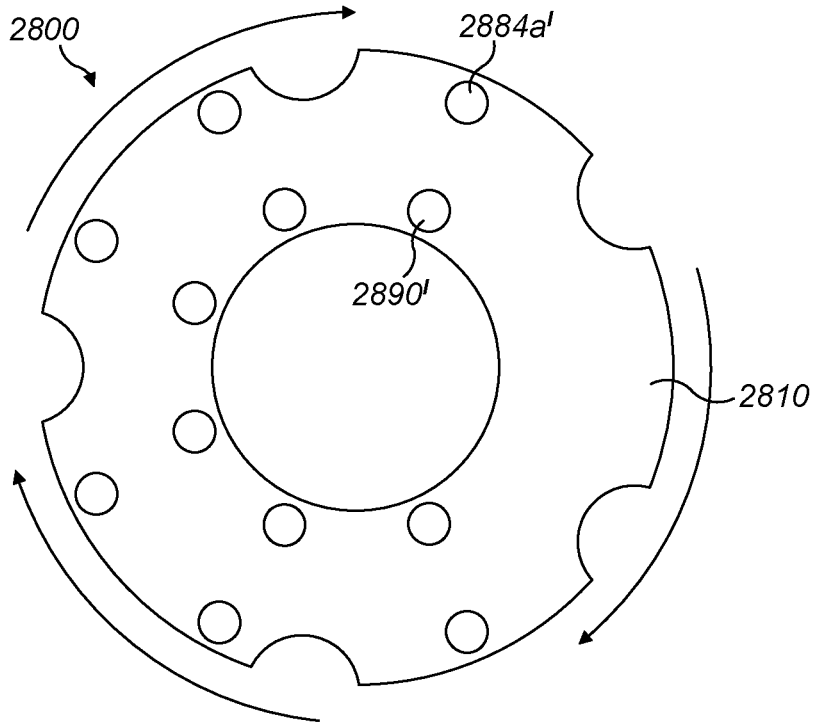
Figure 29:
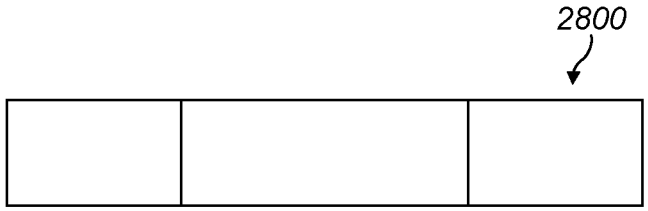
Figure 30:
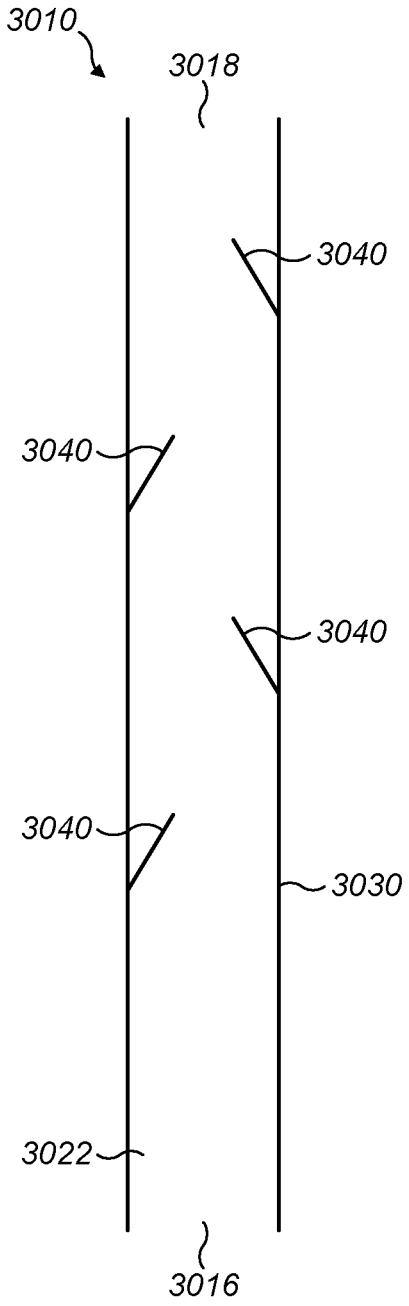
Figure 31:
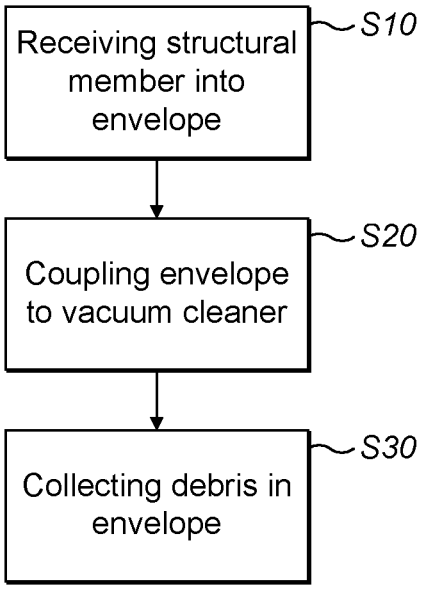

FIG. 27 shows a schematic elevation of a locator member assembly according to another example embodiment;

FIG. 28 shows a schematic elevation of dispensing canister according to an example embodiment;

FIG. 29 shows a schematic cross sectional view of the dispensing canister of FIG. 28;

FIG. 30 shows a schematic cross sectional view of an envelope according to still yet another example embodiment; and FIG. 31 shows a method of using an envelope according to an example embodiment.

DESCRIPTION OF EXAMPLE EMBODIMENTS

With reference to the drawings, similar reference numerals denote corresponding features unless described otherwise.

Figure 2:
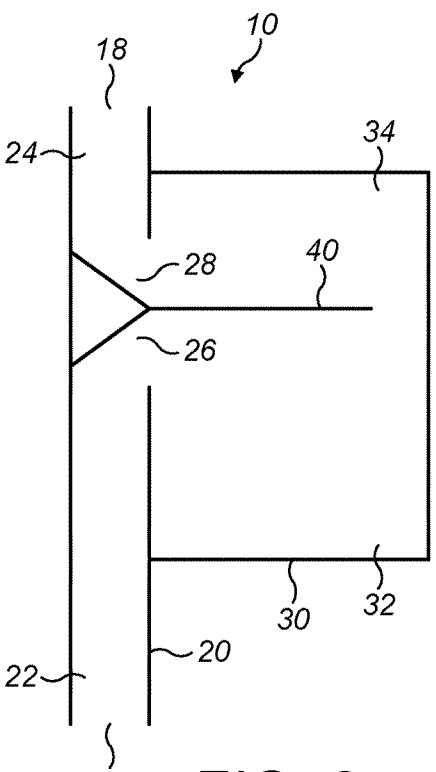
FIG. 2 shows a schematic cross sectional view of the envelope of FIG. 1.

FIGS. 1 and 2 show an envelope 10 according to an example embodiment. Envelope 10 is arranged to receive a structural member (not shown) such that in use, a shape of envelope 10 is maintained. The envelope 10 comprises a tube 20 and a generally cylindrical collection chamber 30, in which a longitudinal axis of tube 20 is arranged parallel to a longitudinal axis of collection chamber 30 and an outer portion of tube 20 is coupled to an outer portion of the collection chamber 30. The envelope 10 comprises an inlet 16 at one end of tube 20 and an outlet 18 at the other end of tube 20. The tube 20 comprises an inlet end 22, corresponding to the inlet 16 of the envelope 10 and an outlet end 24. The collection chamber 30 comprises first chamber, in the form of an inlet chamber 32 and a second chamber in the form of an outlet chamber 34. Inlet end 22 of tube 20 is in fluid communication with inlet chamber 32 of collection chamber 30 through opening 26. Outlet end 24 of tube 20 is in fluid communication with outlet chamber 34 of collection chamber 30 through opening 28. The envelope 10 also comprises a flow diverter 40, coupled to a wall of tube 20 and extending into cylinder 30, normal to a wall of tube 20 and collection chamber 30, through an opening 26, 28 in a wall of tube 20 into cylinder 30. The flow diverter 40 partitions the inlet end 22 from the outlet end 24 of tube 20 and partially partitions the inlet chamber 32 from the outlet chamber 34 in the collection chamber 30. In this way, a fluid path comprises inlet 16, tube inlet end 22, tube inlet opening 26, inlet chamber 32, outlet chamber 34, tube outlet opening 28, tube outlet end 24 and outlet 18.

The envelope is formed of flexible material, in which the flexible material may be impervious and/or biodegradable and/or comprise a plastic. The tube 20 and collection chamber 30 are formed together such that envelope 10 is impervious and non-porous along its length between the inlet 16 and the outlet 18. The tube 20 in use can operate as the nozzle, or fixed to the nozzle of a vacuum cleaner and the collection chamber 30 can collect dirt, inhibiting the passage of dirt into the suction chamber of the vacuum cleaner via the outlet 18, the outlet being fixed to the vacuum produced by the vacuum cleaner.

The envelope 10 may comprise material of a gauge (for example, thicknesses of plastic) to handle heavier industrial cleaning tasks. The envelope 10 is in this example embodiment generally transparent to aid fitment to a vacuum cleaner, with a coloured portion provided to denote the particular category of waste that the envelope 10 is intended to be used for.

Figure 3:
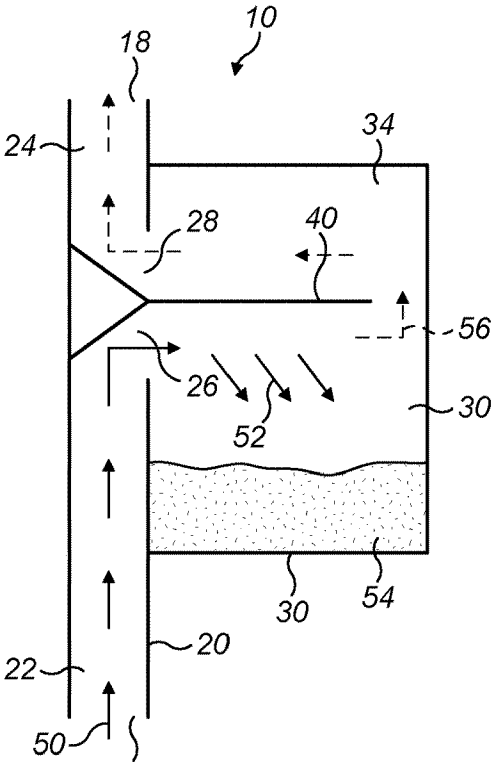
FIG. 3 shows a schematic cross sectional view of the envelope of FIG. 1, in use.

FIG. 3 shows the envelope 10 in use. The envelope 10 is arranged to receive a structural member (not shown) such that in use, a shape of envelope 10 is maintained despite suction being applied to the fluid pathway by the vacuum cleaner in use. Fluid 50 (for example, air comprising particles of dirt 52 enters envelope 10 at inlet 16 and is deflected by flow diverter 40 as the air and particles of dirt 52 move into the collection chamber 30. Particles of dirt 52 are slowed by the flow diverter 40 and fall into inlet chamber 32, where they collect. Air exits the cylinder 30 at the tube outlet 28 and then passes from the outlet 18. The envelope 10 is reinforced, where dirt 52 hits the flow diverter 40.

FIGS. 4*a* and 4*b* show a flow diverter 440' for use with another example embodiment, in which the flow diverter 440' comprises a polymeric semi-circular hollow extrusion and an attachment means arranged on a curved outer surface at an end. The flow diverter 440' may reinforce and/or support an envelope according to an example embodiment, in which the envelope isolates the flow diverter 440' from the fluidic path.

FIG. 5 shows an envelope 510 according to another example embodiment, comprising a tube 520 in fluid communication with a cylindrical collection chamber 530 and further comprising flow diverter cover 540, arranged on, and normal to, an inner surface of the envelope 510 to, in use, deflect a fluid into the collection chamber 530. The flow diverter cover 540 is arranged to receive a flow diverter, such as flow diverter 440'. In this way, the flow diverter 440' may provide structural reinforcement for flow diverter cover 540, without the flow diverter 440' being contaminated by dirt. The envelope 510 is also arranged to receive a structural member (not shown) such that in use, a shape of envelope 510 is maintained.

FIG. 6 shows an envelope 610 according to yet another example embodiment, comprising a tube 620 in fluid communication with a cylindrical collection chamber 630 and further comprising a flow diverter 640 of yet another example embodiment, related to the embodiments of FIGS. 4 and 5 by way of function. The flow diverter 640 comprises a planar member arranged on, and normal to, an inner surface of the envelope 610 to, in use, deflect a fluid into the collection chamber 630. The envelope 610 is also arranged to receive a structural member (not shown) such that in use, a shape of the envelope 610 is maintained.

FIG. 7 shows an envelope 710 comprising a tube 720 in fluid communication with a cylindrical collection chamber 730 and further comprising a flow diverter 740 arranged at a fluid interface between the tube 720 and collection chamber 730. The flow diverter 740 extends across a portion of the tube 720 and substantially across a cross-section of collection chamber 730, thereby partly dividing collection chamber 720 into two parts, in which the two parts are in fluid communication through a circular opening 742. The envelope 710 is also arranged to receive a structural member (not shown) such that in use, a shape of envelope 710 is maintained.

FIG. 8 shows an envelope 810 comprising a tube 820 and in fluid communication with a cylindrical collection chamber 830 and further comprising a flow diverter 840 arranged at a fluid interface between the tube 820 and collection chamber 830. The flow diverter 840 extends across a cross-section of tube 820 and substantially across a cross-section of cylinder 830, thereby partly dividing collection chamber 720 into two parts, in which the two parts are in fluid communication through an opening 842. Envelope 810 is arranged to receive a structural member (not shown) such that in use, a shape of envelope 810 is maintained.

FIGS. 9 and 10 show an envelope 910 according to still yet another example embodiment, comprising a tube 920 in fluid communication with a cylindrical collection chamber 930 and a flow diverter 940, arranged at a fluid interface between tube 920 and collection chamber 930. The tube 920 is arranged concentrically with collection chamber 930. Flow diverter 940 is arranged proximal an outlet end 918 of tube 920 extends across a diameter of tube 920 and extends across a radius of cylinder 930. The envelope 910 is also arranged to receive a structural member (not shown) such that in use, a shape of envelope 910 is maintained.

FIG. 11 shows an envelope 1110 according to still yet another example embodiment. Flow diverter 1140 is arranged proximal the outlet end 1118, extends across a diameter of tube 1120 and extends partly across a radius of cylinder 1130, so as to form a baffle to disrupt a flow of air through the envelope. The envelope 1110 is also arranged to receive a structural member (not shown) such that in use, a shape of envelope 1110 is maintained.

FIGS. 12 and 14 show an envelope 1210 according to still yet another example embodiment. Tube 1220 comprises a first part 1220*a* proximal the inlet 1216 and a second part 1220*b* proximal the outlet 1218. The flow diverter 1240 comprises a truncated cone and is arranged partly across a diameter of cylinder envelope 1230. The envelope 1210 is arranged to receive a structural member (not shown) such that in use, a shape of envelope 1210 is maintained.

FIGS. 13 and 15 show an envelope 1310 according to still yet another example embodiment. Flow diverter 1340 comprises a truncated cone and is arranged partly across a diameter of cylinder 1330. FIG. 16 shows a related embodiment of a flow diverter 1640. The envelope 1310 is also arranged to receive a structural member (not shown) such that in use, a shape of envelope 1310 is maintained.

FIG. 16 shows an envelope 1610 according to still yet another example embodiment. Tube 1620 comprises a first part 1620*a* (not shown) proximal the inlet 1216 (not shown) and a second part 1620*b* (not shown) proximal the outlet 1618. Flow diverter 1640 comprises a plane arranged partly across a diameter of cylinder envelope 1630. Envelope 1610 is arranged to receive a structural member (not shown) such that in use, a shape of envelope 1610 is maintained.

FIG. 17 shows an envelope 1710 according to still yet another example embodiment. Tube 1720 comprises a double-walled plastic bag arranged to receive a first structural member 1760, in which the first structural member 1760 comprises a helical rod. Cylinder 1730 comprises a double-walled plastic bag arranged to receive a second structural member 1770, in which the second structural member 1770 comprises a helical rod. Tube 1720 and cylinder 1730 may be formed to match a shape and a position of the first structural member 1760 and second structural member 1770 respectively and to comprise a flow deflector 1740, by manufacturing and/or fusing and/or heat sealing and/or gluing a double-walled plastic bag. Openings 1726 & 1728 are formed in the tube 1720 between consecutive helical turns of the first structural member 1760.

FIG. 18 shows a schematic cross sectional view of an envelope 1810 according to still yet another example embodiment, in which tube 1820 is arranged to receive a first structural member 1860*a* and a second structural member 1860*b* in a helical conduit formed in a wall of the envelope 1810. First structural member 1860*a* and second structural member 1860*b* comprise helical rods that may be inserted into the helical conduit in the envelope 1810. By displacing first structural member 1860*a* relative to second structural member 1860*b*, the envelope 1810 may be stressed, thereby supporting a shape of the envelope 1810.

While some examples of the structural member have been described, the structural member should not be considered limited to these descriptions and other examples of structural members may be provided e.g. an umbrella-style structural member in which a biased (i.e. sprung or tensioned or compressive) member supports the envelope.

FIG. 19 shows a schematic cross sectional view of an envelope 1910 according to still yet another example embodiment, in use. Envelope 1910 comprises a tube 1920 arranged to receive and comprises a structural member 1960. The cylinder 1930 is arranged to receive and comprises a structural member (not shown). Fluid 1950 (for example, air and/or dirt) enters envelope 1910 at inlet 1916 and is deflected by flow diverter 1940. Dirt 1952 is slowed by flow diverter 1940 and falls into cylinder inlet chamber 1932, where the dirt 1954 collects. Air 1956 exits the cylinder 1930 at tube outlet 1928 and hence outlet 1918.

FIG. 20 shows a schematic cross sectional view of a vacuum cleaner 2001 according to an example embodiment. Vacuum cleaner 2001 comprises a retractable handle 2080, a fill point & stopper 2081, a water tank 2083, a water pipe to envelope 2084, a battery 2085, a circuitry and/or water valve and/or spray 2086, an electric motor 2087, a downwards vent 2088, a fan 2089, an optional HEPA filter 2090, an envelope holder 2091 (e.g. male locator member 2680, as described below), structural member storage and deployment mechanism and an optional water nozzle 2092.

Vacuum/fan of vacuum cleaner 2001 has suck and blow functions and comprises an IC unit. There may be a moisture monitor at or near the fan and the IC may shut down the motor/close access to the motor/fan at pre-determined moisture levels. Motor 2087 may be DC, AC and/or BLOC (brushless). A level sensor in this embodiment provided as a spirit level is arranged to monitor the horizontal position of the vacuum cleaner and warn the user and/or shut down the device/close access to the motor/fan if the vacuum is tilted beyond a certain angle. A moisture monitor may be replaced by a flotation valve in other embodiments. A fluid storage tank and spray/pump may be fitted to allow fluid to be dispensed into the material collection chamber through the outlet; and prior to usage and/or after usage of the envelope to spray a spoilage area. Fluid may comprise water and may further comprise: an anti-bacterial agent and/or a surfactant; and/or a detergent; and/or a scent.

Vacuum cleaner 2001 and envelope 10 may be of small portable design, for example a handheld portable unit with handle extender placing the vent of the fan near ground level and away from the user for hygienic vacuuming of pet excrement, or a garden vacuum cleaner (e.g. a leaf blower that also comprises a vacuum cleaner function) or a pool vacuum cleaner (e.g. for catching and containing floating or sunken effluent or debris), or may be scaled up for larger industrial wheeled units with appropriate industrial specifications. The motor and fan may be scaled up or down to suit the intended cleaning task. Whilst some examples of a type of vacuum cleaner and application of the vacuum cleaner have been described, these examples are not to be considered limiting to the type of vacuum cleaner and other examples may be provided of other types of vacuum cleaners and applications.

A number of envelopes 10 may be stored and attached to the vacuum cleaner 2001 with all envelopes 10 having aligned open fluid path holes and staggered structural member holes, each of which is close ended. Each envelope 10 could be attached to the following envelope 10 with perforations to aid removal. Turning the envelope 10 and fixing member or the structural member moves the structural member to the next unused envelope. Envelopes 10 may be held within a removable dispensing canister at or near the fan such that each new envelope may be pushed from the canister. Alternatively the envelope 10 may be individually inserted and removed possibly with its own attached filter mounted on a fixing member such as a ring. The vacuum cleaner 2001 may be used on an extending arm with the fan(s) venting downwards, away from the user.

The optional use of a small, disposable filter and addition of water in the envelope to aid dirt capture means that larger filters that reduce the power of conventional vacuum cleaners are not necessarily required. If outside there would be no need for further filters, however indoors a HEPA filter could be fitted either before and/or after the fan(s). A surfactant may be added to the water to decrease surface tension and aid dirt capture.

Sensors may connect with an IC to monitor angle of tilt/moisture levels and ensure cut-off/closure of a valve preventing damage to the motor. The IC may manually or automatically cycle through a number of phases e.g. fan in low reverse to push air through hollow structural members to inflate envelope 10 and allow easier insertion of structural member, structural member may be automatically pushed by motor into the envelope 10. Then, after vacuuming, inflation into a structural member may aid retraction of structural member from the envelope 10.

Vacuum cleaner 2001 may be small and easily portable with an extending arm, limited battery life, power and volume to hygienically vacuum small pet excrement or scalable to larger animals or other purposes such as industrial applications including hospital cleaning and capturing of saw dust. Vacuum cleaner 2001 may in other embodiments have wheels, be hand held, be of a canister vacuum cleaner, a back pack vacuum cleaner or be configured to collect liquids or be centrally fitted.

For outside portable use as animal excrement remover, the vacuum cleaner 2001 need only have sufficient battery life for a few short bursts of usage, for example 3 to 5 minutes total, a small collection chamber size for a small amount of excrement, a smaller motor and short inlet tube placing device as close as possible to the ground, a biodegradable envelope 10 and filter so envelope 10 may be sealed and disposed of easily and hygienically. The only part of the vacuum cleaner 2001 that may experience any contamination is after the filter (fan and outside vent). If envelope 10 perforates and/or is damaged, a structural member may be washed/fully immersed in solution to clean. The fixing member may be made comprise cardboard and/or plastic; the membrane making up the envelope may comprise a polymer e.g. polylactide.

FIG. 21 shows a schematic cross-sectional view of an envelope according to still yet another example embodiment, further comprising a wheel 2199, to facilitate transportation of envelope 2110 as part of a vacuum cleaning system.

FIG. 22 shows a schematic perspective view of an envelope 2210 according to still yet another example embodiment. Tube 2220 comprises openings 2226 and 2228. Flow deflector 2240 extends across a cross section of tube 2220 and extends substantially across a cross section of cylinder envelope 2230. Cylinder 2230 is arranged to receive a first circular structural member 2272*a*, for example a hoop, in a double-walled pocket of envelope 2210 arranged around a circumference of the cylinder envelope 2230 at one end of the cylinder envelope 2230 and a second circular structural member 2272*b*, for example a hoop, in a double-walled pocket of envelope 2210 arranged around a circumference of the cylinder envelope 2230 at the other end of the cylinder envelope 2230. Cylinder 2230 is also arranged to receive a longitudinal structural member 2274, fixing structural members 2272*a* and 2272*b*, extending from one end of the cylinder 2230 to the other end of the cylinder 2230. In this way, a structural member may be inserted into a pocket of envelope 2210 so as to, in use, maintain a shape of envelope 2210.

FIG. 23 shows a schematic perspective view of an envelope 2310 according to still yet another example embodiment. Tube 2320 comprises openings 2326 and 2328. Flow deflector 2340 extends across a cross section of tube 2220 and extends substantially across a cross section of cylinder envelope 2330. Cylinder 2330 is also arranged to receive a plurality of structural members 2374 extending from one end of the cylinder 2330 to the other end of the cylinder envelope. Envelope 2310 comprises a plurality of structural members 2374 in use. Tube 2320 is also arranged to receive a structural member (not shown).

FIG. 24 shows a schematic perspective view of two structural members 2374 according to an example embodiment, for use, for example with the example embodiment of FIG. 23. For example, structural member 2374 may be inserted into and/or retracted from the cylinder 2330 of the envelope 2310. Structural member 2374 comprises a rod comprising two parts: a longitudinal part 2374*a* coupled at one end to a curved part 2374*b*, in which curved part 2374*b* extends along substantially half a circumference in a plane orthogonal to longitudinal part 2374*a*.

FIG. 25 shows a schematic plan view of an envelope 2310. Envelope 2310 is arranged to receive longitudinal part 2374*a* in a longitudinal cavity of cylinder 2330 and is further arranged to receive curved part 2374*b* in a pocket in an end of cylinder 2330. In use, a longitudinal part 2374*a* is rotated about its longitudinal axis, thereby tending to rotate a coupled curved part 2374*b*, thereby tensioning cylinder 2330.

In a further embodiment of FIG. 25, envelope 2310 is arranged to receive longitudinal part 2374*a* in a longitudinal cavity of cylinder 2330 supported by curved part 2374*b* at the outlet 2324 end of cylinder 2330. In use, a longitudinal part 2374*a* is extended into a conduit within envelope 2310 then rotated about its longitudinal axis by rotating the coupled curved part 2374*b*, thereby tensioning cylinder 2330.

FIG. 26*a* shows a schematic elevation of a male locator member 2680 according to an example embodiment. Male locator member 2680 may be arranged to couple an envelope, for example envelope 910, to a vacuum cleaner. Male locator member 2680 comprises a ring, comprising plastic and/or cardboard, to receive an envelope and one or more structural members. A male locator member 2680 may be arranged to receive an envelope, for example envelope 910, in which envelope 910 may be coupled (e.g. bonded during manufacturing for supply to a user in a bonded form) to the male locator member 2680 so as to provide a relative alignment of male locator member 2680 and envelope 910. Alternatively, a pair of male locator members 2680 may be arranged to receive the envelope 910, in which envelope 910 is be arranged between the pair of male locator members 2680 (i.e. sandwiched between the pair of male locator members 2680) so as to provide a relative alignment of the pair of male locator members 2680 and envelope 910. The male locator member 2680 or pair of male locator members 2680 are coupled to cylinder 930 proximal outlet 918. For example, the male locator members 2680 may be received by a mating coupling (not shown) provided by a vacuum cleaner or by mating coupling (not shown) that comprises a push-fit type attachment suitable for attachment to a vacuum cleaner hose. This mating coupling arrangement allows the user to reliably and easily fit the envelope 910 to the vacuum cleaner, without for example the user being required to sandwich the envelope 910. A bore of male locator member 2680 is arranged to receive a fluidic path provided by outlet 924 of envelope 910. Five equidistant circular openings 2684*a* are arranged on a locus of male locator member 2680, wherein each opening 2684*a* is arranged to receive a structural member 2374*a*. A semi-circular perforated tear line 2684*b* is arranged on an outer diameter of male locator member 2680 and around an opening 2684*a*. Five equidistant semi-circular openings 2682*a* are arranged on an outer diameter of male locator member 2680 and between openings 2684*a*. A further circular opening 2690 is arranged at a radius of male locator member 2680, to receive another structural member (e.g. helical structural member 1760). By coupling the male locator member 2680 to the envelope 910, a relative alignment of male locator member 2680 and envelope 910 may be provided. Particularly, the relative alignment of the circular opening 2684*a*, arranged to receive structural members 2374*a*, and the relative alignment of the circular opening 2690, arranged to receive a structural member (e.g. helical structural member 1760) and the outlet end 918 of envelope 910 may be provided. For example, structural members 2374*a* may be inserted e.g. pushed into the envelope 910 in tandem with rotation of the helical structural member 1760, unwrapping a compacted envelope 910 until at full tension/extension and then (as shown in FIG. 25), the structural members 2374*a* rotate outwards tearing away from the male locator member 2680 along tear line 2684*b* and unwrapping the envelope 910, locking at full deployment of the cylinder 930.

FIG. 26*a* also shows a schematic elevation of a female locator member 2688, arranged to receive male locator member 2680 and arranged to be coupleable to a vacuum cleaner. For example, female locator member 2688 may couple e.g. push-fit, screw onto a vacuum cleaner or may be integrated with a vacuum cleaner. Female locator member 2688 may be arranged to be coupleable to male locator member 2680, wherein male locator member 2680 may be coupled to female locator member 2688 by, for example, rotating and releasably securing male locator member 2680 to female locator member 2688, thereby providing a relative alignment of the fluid path and circular opening 2684*a* and circular opening 2690 and a conduit of envelope 910. FIG. 26*a* also shows a schematic elevation of the male locator member 2680 coupled to the female locator member 2688, as a locator member assembly 2695. In use, male locator member 2680 may be arranged to couple an envelope to a vacuum cleaner and or/vacuum pump. Male locator member 2680 is received by a female locator member 2688, in which female locator member 2688 is coupled to a vacuum cleaner, in which an envelope 910 is coupled to the male locator member 2680, as described above. Openings 2682*a* of male locator member 2680 are aligned with protrusions 2682*b* of female locator member 2688. Male locator member 2680 may be pressed and/or pushed towards female locator member 2688 and male locator member 2680 then rotated relative to female locator member 2688, thereby locking male locator member 2680 and female locator member 2688 and securing an envelope coupled to male locator member 2680. A structural member 2374 may be inserted into opening 2684*a* and hence into a conduit of envelope 910 and rotated about its longitudinal axis, thereby tensioning an envelope. In use, male locator member 2680 may tear along a tear line 2684*b* while structural members 2374*a* are inserted into opening 2684*a* and hence into a conduit of envelope 910, pushed then rotated about its longitudinal axis, thereby tensioning an envelope. Another structural member (e.g. helical structural member 1760) may be inserted (e.g. at the same time, before or after) into opening 2690 and hence into a conduit of envelope 910 and rotated about its longitudinal axis, thereby supporting an inner tube of an envelope, as described previously. Particularly, where male locator member 2680 comprises one circular opening 2684*a*, a structural member 2374*a* may be inserted, as described previously. Further, locator member assembly 2695 may comprise retracted structural members 2374 and/or circular openings 2684*a* and/or retracted helical structural member 1760 and/or circular opening 2690 in a tube, e.g. tube 1920 as described previously, comprising a mechanism to retract, store and deploy the retracted structural members. The tube 1920 would allow the structural members 2374 to rotate outwards from 2688.

In more detail, FIG. 26*b* shows a schematic exploded perspective elevation of the locator member assembly 2695 according to the example embodiment of FIG. 26*a*. The outlet end 918 of the envelope 910 is bonded between a pair of male locator members 2680*a* and 2680*b*, forming assembly 2699, such that circular openings 2684*a* of male locator member 2680*a* and semi-circular openings 2682*a* of male locator member 2680*b* are aligned appropriately for female locator member 2688, as described above.

In this way, male locator member 2680 may be manufactured and bonded in two or more parts while to a user, male locator member 2680 allows easy and consistent alignment of the conduits (e.g. a conduit of envelope 910 arranged to couple a structural member) with the structural members (e.g. structural member 2374*a*). In use, male locator member 2680 does not separate at any time except for a number of small tear off semi-circular strips along tear line 2684*b*, which allows the liner 910 of the material collection chamber to spread outwards as the structural members (e.g. structural member 2374*a*) fan out whilst male locator member 2680 itself remains secured to female locator member

2688. Female locator member 2688 may further comprise stored structural members (e.g. structural member 2374 and/or structural member 1760) and a mechanism to deploy and retract these structural members.

FIG. 27 shows a schematic elevation of a male locator member 2780 according to another example embodiment, related to the embodiment of FIG. 26. The male locator member 2780 may be arranged to couple an envelope to a vacuum cleaner, as described with reference to the male locator member 2680. Male locator member 2780 comprises a ring, comprising plastic and/or cardboard, to receive an envelope and a structural member. A bore of male locator member 2780 is arranged to receive a fluidic path provided by an envelope. A circular opening 2784*a* is arranged on a locus of male locator member 2780, wherein an opening 2784*a* is arranged to receive a structural member. Five equidistant semi-circular openings 2782*a* are arranged on an outer diameter of male locator member 2780. A further circular opening 2790 is arranged at a radius of male locator member 2780, to receive another structural member.

In use, male locator member 2780 may be arranged to couple an envelope to a vacuum cleaner. Male locator member 2780 is received by a female locator member 2788, in which female locator member 2788 is coupled to a vacuum cleaner, in which an envelope is coupled to male locator member 2780, as described above. Openings 2782*a* of male locator member 2780 are aligned with protrusions 2782*b* of female locator member 2788. Male locator member 2780 may be pressed and/or pushed towards female locator member 2788 and male locator member 2780 then rotated relative to female locator member 2788, thereby locking male locator member 2780 and female locator member 2788 and securing an envelope coupled to male locator member 2780. A helical structural member 1760 (not shown) may be inserted into opening 2784*a* and hence into a conduit of envelope 910 and rotated about its longitudinal axis, thereby tensioning an envelope. Another helical structural member 1760 (not shown) may be inserted into opening 2790 and hence into another conduit of envelope 910 and rotated about its longitudinal axis, thereby supporting an inner tube of an envelope. Female locator member 2788 may comprise retracted helical structural members 1760 and a mechanism to deploy the retracted structural members 1760.

FIG. 28 shows a schematic elevation of dispensing canister 2800 according to an example embodiment. Dispensing canister 2800 may be arranged to receive a plurality of envelopes for example 2, 3 4, 5, 6, or more envelopes, for example, an envelope 2810. Envelope 2810 comprises a pair of fixing members, for example male locator members 2680, arranged as described with reference to FIG. 26. An envelope 2810 mayor may not be releasably coupled to another envelope 2810. Envelope 2810 comprises a conduit 2884*a*' arranged to receive a structural member. Envelope 2810 comprises another conduit 2890' arranged to receive another structural member. An envelope 2810 is rotated about a longitudinal axis of dispensing canister 2800 with respect to another envelope 2810. For example, an envelope 2810 is rotated 60° about a longitudinal axis of dispensing canister 2800 with respect to another envelope 2810, in which dispensing canister 2800 is arranged to receive a plurality of envelopes for example 2, 3 4, 5, 6, or more envelopes 2810. In use, a structural member is inserted into conduit 2884*a*' and hence into a conduit of envelope 910 and another structural member is inserted into conduit 2890' and hence into another conduit of envelope 910. After using the vacuum cleaner, the structural members are removed and the envelope 2810 sealed for disposal. Dispensing canister 2800 is rotated 60° about a longitudinal axis of dispensing canister 2800 to present another envelope 2810.

FIG. 29 shows a schematic cross-sectional view of the dispensing canister of FIG. 28, arranged to receive a plurality of envelopes for example 2, 3 4, 5, 6, or more envelopes (not shown).

FIG. 30 shows a schematic cross-sectional view of an envelope 3010 according to still yet another example embodiment, comprising a tubular collection chamber 3030 and a plurality of flow diverters 3040. The envelope 3010 is arranged to receive a structural member (not shown), such as the structural member 1760, such that in use, a shape of envelope 3010 is maintained. The flow diverters 3040 comprise a plurality of members arranged on, and inclined to, an inner surface of the envelope 3010 to, in use, deflect a fluid into one or more regions formed between the tubular collection chamber 3030 and the flow diverters 3040. Alternatively, the flow diverter 3040 comprises a helical member arranged on, and inclined to, an inner surface of the envelope 3010 to, in use, deflect a fluid into one or more regions formed between the tubular collection chamber 3030 and the flow diverter 3040. In this way, the structural member may be withdrawn in use (i.e. with the vacuum cleaner operating) and the fluid deflected into the one or more regions formed between the tubular collection chamber 3030 and the flow diverters 3040 is retained. Further, an end of the envelope 3010 may be closed (e.g. tied shut) or both ends of the envelope 3010 may be closed, thereby isolating the fluid in the envelope 3010.

FIG. 31 shows a method of using an envelope according to an example embodiment. At S10, a structural member is coupled to the envelope to support the envelope, such as in this embodiment by being received into a wall portion of the envelope. At S20, the envelope is coupled to a vacuum source, for example, a vacuum cleaner. At S30, the vacuum cleaner is used to vacuum debris whereby debris is collected in the envelope.

Optionally, the method further comprises uncoupling an end of the envelope, for example a fixing member, from a vacuum cleaner. Optionally, the method further comprises closing an end of the envelope. Optionally, the method further comprises removing a structural member from the envelope. Optionally, the method further comprises disposing of the envelope.

As set out above, envelopes and assemblies according to the example embodiments provide a removable and readily replaceable part that can inhibit dirt from passing into a vacuum cleaner. Further, the envelope may provide complete coverage of the fluid path from an inlet to an outlet and hence provide end-to-end coverage for the portions exposed to dirt when the vacuum cleaner is used. In this way, the envelope may be a barrier between wet and/or dry dirt that is vacuumed up by a vacuum cleaner. The envelope receives dirt for safe and hygienic disposal, facilitated by the ends of the envelope being sealed before the envelope is uncoupled from the vacuum cleaner.

The features described herein are suitable for inclusion in a vacuum cleaner at time of first manufacture, or can be retrofitted to existing vacuum cleaners in situ as appropriate.

Although a few preferred embodiments have been shown and described, it will be appreciated by those skilled in the art that various changes and modifications might be made without departing from the scope of the invention, as defined in any appended claims.

Attention is directed to all papers and documents which are filed concurrently with or previous to this specification in connection with this application and which are open to public inspection with this specification, and the contents of all such papers and documents are incorporated herein by reference. All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An envelope (2310) for use with a vacuum cleaner, the envelope comprising flexible material arranged to provide a fluid path there-through, and further comprising a coupling arranged to couple the envelope to a structural member (2374) for in use maintaining the fluid path open by supporting the envelope (2310) against external pressure;

wherein:

the envelope (2310) is arranged in use to isolate, from the fluid path, the structural member (2374) that supports the envelope;

the envelope comprises an impermeable material; characterized in that the coupling comprises a conduit arranged to removably couple the structural member (2374) thereto.

2. The envelope according to any preceding claim, wherein the envelope provides the fluid path with a single inlet (2316) and a single outlet (2318).

3. The envelope according to any preceding claim, wherein the envelope comprises a first chamber to in use receive incoming fluid or to collect dirt.

4. The envelope according to any preceding claim, wherein the envelope comprises a flow diverter (2340).

5. The envelope according to any preceding claim, wherein the coupling is arranged to receive the structural member by insertion of the structural member into the coupling.

6. The envelope according to any preceding claim, wherein the structural member is arrangeable to extend along an axis of the envelope.

7. The envelope according to any preceding claim, wherein the coupling is arranged to couple the envelope to the structural member such that the envelope is in use stressed by the structural member.

8. The envelope according to any preceding claim, wherein the envelope comprises a fixing arranged to fix the envelope to the vacuum cleaner.

9. The envelope according to any preceding claim, wherein the envelope comprises a filter.

10. The envelope according to any preceding claim, wherein the envelope comprises a closure feature.

11. A method of using an envelope according to any of the preceding claims with a vacuum cleaner, the method comprising:

receiving the structural member (2374) into the conduit of the envelope, (2310) thereby supporting the envelope with the structural member;

fixing the envelope to the vacuum cleaner; and operating the vacuum cleaner to collect dirt in the envelope; and wherein the method of using the envelope further comprises removing the structural member from the envelope after operating the vacuum cleaner.

12. The method of using the envelope according to claim 11, wherein the method comprises fixing an end of the envelope to the vacuum cleaner.

13. A kit of parts for an envelope for use with a vacuum cleaner, wherein the kit of parts comprises: an envelope according to any of claims 1-10 and the structural member.

14. An envelope assembly for use with a vacuum cleaner, the envelope assembly comprising:

an envelope for use with a vacuum cleaner according to any of claims 1-10 and the structural member that is coupled to the coupling and that supports the envelope.

15. A vacuum cleaner system comprising:

a vacuum cleaner and an envelope assembly according to claim 14 for use with the vacuum cleaner.

* * * * *